US006604740B1

(12) United States Patent
Singer et al.

(10) Patent No.: US 6,604,740 B1
(45) Date of Patent: Aug. 12, 2003

(54) SLOT MACHINE GAME HAVING A PLURALITY OF WAYS TO DESIGNATE ONE OR MORE WILD SYMBOLS (SELECT-A-WILD)

(75) Inventors: Anthony M. Singer, Ringwood, NJ (US); Joseph D. Masci, Ossining, NY (US); Howard M. Marks, Westport, CT (US); Daniel M. Marks, Brooklyn, NY (US)

(73) Assignee: PTT, LLC, Nanuet, NY (US)

( * ) Notice: Subject to any disclaimer, the term of this patent is extended or adjusted under 35 U.S.C. 154(b) by 0 days.

(21) Appl. No.: 10/105,627

(22) Filed: Mar. 26, 2002

Related U.S. Application Data

(60) Provisional application No. 60/279,106, filed on Mar. 28, 2001.

(51) Int. Cl.[7] ..... A63F 1/00

(52) U.S. Cl. ..... 273/292; 273/143 R; 463/13; 463/16; 463/20

(58) Field of Search ..... 273/292, 236, 273/264, 238, 284; 463/20, 13, 16

(56) References Cited

U.S. PATENT DOCUMENTS 4,817,951 A * 4/1989 Crouch et al. ..... 463/20
5,163,131 A 11/1992 Row et al.
5,580,053 A * 12/1996 Crouch ..... 463/20
5,685,774 A * 11/1997 Webb ..... 463/13
5,976,016 A * 11/1999 Moody et al. ..... 463/13
6,012,720 A * 1/2000 Webb ..... 273/292
6,015,346 A * 1/2000 Bennett ..... 463/20
6,056,641 A * 5/2000 Webb ..... 463/13
6,089,977 A * 7/2000 Bennett ..... 463/20
6,120,031 A * 9/2000 Adams ..... 273/292
6,120,378 A * 9/2000 Moody et al. ..... 463/20
6,227,971 B1 * 5/2001 Weiss ..... 463/20
6,234,897 B1 * 5/2001 Frohm et al. ..... 463/20
6,237,916 B1 * 5/2001 Webb ..... 273/292
6,290,600 B1 * 9/2001 Glasson ..... 463/20
6,299,170 B1 * 10/2001 Yoseloff ..... 273/292
6,311,976 B1 * 11/2001 Yoseloff et al. ..... 273/138.2
6,322,078 B1 * 11/2001 Adams ..... 273/292
6,358,147 B1 * 3/2002 Jaffe et al. ..... 463/20
6,454,266 B1 * 9/2002 Breeding et al. ..... 273/292
6,494,454 B2 * 12/2002 Adams ..... 273/292
6,514,141 B1 * 2/2003 Kaminkow et al. ..... 463/25
6,517,432 B1 * 2/2003 Jaffe ..... 463/16
6,517,433 B2 * 2/2003 Loose et al. ..... 463/20

OTHER PUBLICATIONS

David Schwartz, Steve Ryan & fred Wostbrock—The Encyclopedia Of TV GameShows– 1999– Checkmark Books—3rd Edition pp. 112–114.*
Walter B. Gobson—Hoyle's Modern Encyclopedia of Card Games Nov. 21, 2001—Doubleday– pp. 32–35.*
Boxer, Aaron. "Where Buses Cannot Go." *IEEE Spectrum*, Feb. 1995, pp. 41–45.
Barroso, Luiz André., Sasan Iman, Jaeheon Jeong, Koray Öner, and Michel Dubois. "RPM: A Rapid Prototyping Engine for Multiprocessor Sytems." *IEEE Computer*, Feb. 1995, pp. 26–34.

* cited by examiner

*Primary Examiner*—Benjamin H. Layno
*Assistant Examiner*—Dolores R. Collins
(74) *Attorney, Agent, or Firm*—Irah H. Donner; Hale and Dorr LLP

(57) ABSTRACT

A slot machine enables a player to select one or more symbols as wild symbols ("Select-A-Wild"). In one embodiment, the game displays three spin buttons. Each spin button is permanently associated with a symbol. All of the associated symbols have matching symbols on the reel strips. Each of the associated symbols have the same probability of appearing on the reel strips. The player selects a wild symbol by pressing a spin button. The symbol associated with the pressed spin button acts as a wild symbol for that spin. After each spin, the player receives awards for all winning combinations.

26 Claims, 38 Drawing Sheets

SLOT MACHINE GAME HAVING A PLURALITY OF WAYS TO DESIGNATE ONE OR MORE WILD SYMBOLS (SELECT-A-WILD)

RELATED APPLICATIONS

This application claims priority to U.S. application Ser. No. 60/279,106, filed Mar. 28, 2001, titled "Slot Machine Game Having A Plurality of Ways For A User to Intuitively Obtain Payouts ("Emerald City")," and incorporated herein by reference.

BACKGROUND OF THE INVENTION

1. Field of Invention

This invention relates generally to payout methods in a mechanical, an electro-mechanical and/or computer-based slot machine-like games-of-chance.

2. Background Description

To play a slot machine a player deposits money in the form of coins, gaming tokens or paper currency either into a coin head or bill acceptor. The coins and gaming tokens are collected in a reservoir inside the gaming machine while the paper currency is collected in the bill acceptor inside the gaming machine. If the coins, gaming tokens or paper currency are validated as authentic, the player accrues the appropriate number of playing credits on a credit meter. For example, a twenty-five cent gaming machine will accrue four credits for each dollar deposited into the gaming machine.

After accruing credits on the credit meter, the player determines how many credits he wishes to wager on the next spin of the slot reels. After setting the wager, the player spins the reels by pressing the spin button or by pulling a handle. When the reels stop spinning, symbols are displayed on the slot reels ("symbol matrix"). The player then collects credits for predetermined symbol combinations ("winning combinations"), if any, according to a pre-determined schedule ("pay table"). More specifically, the standard slot machine operates as follows:

Symbol Matrix. Slot symbols are displayed on 3 or more slot reels (also called "columns") placed adjacent to each other. Each column contains at least 3 rows, with a symbol in each row. The resulting matrix of symbols ("symbol matrix") typically ranges from 3 columns by 3 rows with 9 total symbols to 5 columns by 3 rows with 15 total symbols. Within the symbol matrix, positions on the slot reels may be referred to according to column, from left to right, and row, from the top to bottom ("symbol positions"). For example: symbol position ½ is located in column 1 (i.e., left-most column) and row 2 (i.e., middle row).

Winning Combinations. Players collect credits for predetermined winning symbol combinations that appear in specific locations ("pay lines") on the slot reels. Winning combinations typically require that three or more of the same symbols appear adjacent to each other starting from the leftmost position of a pay line ("line pays"). For example: a player may collect a line pay if 3 Banana symbols appeared in symbol positions 1/1, 2/1, 3/1 on a pay line using symbol positions 1/1, 2/1, 3/1, 4/1, and 5/1. Alternatively, players may also collect credits for predetermined winning combinations that appear anywhere on a pay line ("line scatter pays") or anywhere on the slot reels ("reel scatter pays"). For example, a player may collect a line scatter pay if 3 Banana symbols appeared in symbol positions 1/1, 3/1, 5/1 on a pay line using symbol positions 1/1, 2/1, 3/1, 4/1, and 5/1; and collect a reel scatter pay if 3 Banana symbols appeared anywhere on the slot reels.

Pay Table. Credits are awarded to the player for each winning symbol combination based on a predetermined schedule ("pay table"). For line pays and line scatter pays, the number of credits wagered on the winning pay line multiplies the number of credits indicated by the pay table. For example, a player may wager two credits each on five pay lines, spin the reels, and collect twice the amount indicated on the pay table for a line pay or line scatter pay appearing on any of the five played pay lines. For reel scatter pays, the total number of credits wagered multiplies the number of credits indicated by the pay table. For example, a player may wager ten total credits, spin the reels, and collect ten times the amount indicated on the pay table for a reel scatter pay appearing on anywhere on the slot reels.

Following any type of pay (e.g., line pays, line scatter pays and reel scatter pays), the credits won are added to the player's balance of credits shown in the credit meter. As long as the player has credits on the credit meter, the player may continue to play the gaming machine or the player may collect the remaining balance of credits by pressing a Cash Out button the gaming machine. In addition, the player may view the rules of the game by pressing the Help button before any spin.

A conventional slot machine issues awards according to the methods described above and exemplified by FIGS. 1, 2, and 3. FIG. 1, U.S. Pat. No. 5,580,053 to Crouch, entitled Multi-Line Gaming Machine, incorporated herein by reference, discloses a gaming machine 50 that has a display 51 on which an array of symbols is displayed. The array is typically 3 rows×5 columns. During a game the symbols displayed on the array are caused to change with a random result being obtained. The player of the machine makes a wager on the result and is paid a prize if one of a number of predetermined combinations of symbols are displayed on a line of the display 51 at the end of the game. The player may make multiple wagers on each game with each wager being assigned to a different one of a plurality of possible result lines. Typically, the number of possible result lines is greater than or equal to 9, and the lines to be employed in each game are selected by switches 54, prior to a game being initiated.

FIG. 2, as disclosed in U.S. Pat. No. 5,580,053, shows a 3×5 display 51 having 12 paylines, indicated by numerals 1 to 12*i*. FIG. 3, as disclosed in U.S. Pat. No. 5,580,053, shows a 3×5 display 51 having 27 paylines, indicated by numerals 1 to 27 on the Figure.

A conventional slot machine, therefore, limits players, casinos and manufacturers, as follows:

Players suffer from the boredom of playing "new" games with different graphics, but really use same "old" awards;

Casinos suffer from the players' dissatisfaction with the casino's game selection as they cannot distinguish their game offerings from other casinos; and Game manufacturers suffer declining orders as they cannot distinguish their product line from the other manufacturers.

SUMMARY OF THE INVENTION

It is an object of the present invention to address the limitations associated with conventional slot machines by creating additional and/or enhanced awards.

It is one feature and advantage of the present invention to provide a game that provides an award based upon the player's selection of, for example, one or more symbols as wild symbols ("Select-A-Wild"). The Select-A-Wild concept creates a slot game with a wider variety of awards which benefits all parties: the game manufacturer adds a unique product to their sales line; the casino attracts and retain players interested in playing an innovative slot game; and the player enjoys a new method of receiving an award. Other objects, features and advantages of the present invention are described below.

The present invention includes a variety of methods of play that can be programmed on an electronic video slot machine to enable the player to select one or more symbols as wild symbols ("Select-A-Wild") for one or more spins using one or more spin buttons for at least one game or set of games.

In a preferred embodiment of the present invention, the Select-A-Wild concept allows the player to select the wild symbol every spin, as follows:

- The game displays three spin buttons (other number of spin buttons may alternatively be used).
- Each spin button is permanently associated with a symbol:
  - All of the associated symbols have matching symbols on the reel strips.
  - Each of the associated symbols have the same probability of appearing on the reel strips.
- The player selects a wild symbol by pressing a spin button.
- The symbol associated with the pressed spin button acts as a wild symbol for that spin:
  - Symbols on the reel strips matching the selected symbol replace any or all other symbols in determining winning outcomes.
  - Symbols on the reel strips matching the non-selected symbols are not wild, but do award line pays.
- After each spin, the player receives awards for all winning combinations, including pays using the selected wild symbol.

For example: consider the numbers 1 to 9 to represent the symbol set; the numbers 7, 8, and 9 may be eligible to be selected as a wild symbol; and the player selects 8 as the wild symbol:

2 1 6 4 7

5 5 *8* 3 5

9 6 6 6 2 winning combination in bold

Selected Wild in bold italic

The game awards credits for the winning symbol combination of 5-5-5 on pay line 1. Although pay line one display 5-5-8, the 8 symbol is wild and acts as a 5 symbol to make a 5-5-5 combination. Note that the 6-6-6 combination is not awarded in this example because the combination does not begin from the left most column.

Note that the player's selection of wild symbols affects the game's outcome. In the example above, if the player had selected the 9 as wild, the game would not have paid for the 5-5-8, but would have paid for the 9-6-6-6 combination on pay line 3.

The preferred embodiment of the present invention, therefore, offers a new "variable" wild symbol that changes from spin to spin, with each selected wild symbol offering a different opportunity for an additional award.

Alternatively, the present invention allows for many alternative embodiments, including but not limited to the following:

- Any number of wild symbols to select from. The present invention allows for offering any number of wild symbols to the player, from one to a plurality of symbols. The number of wild symbols offered may vary according one or more factors, such as amount of pay lines wagered upon, amount of the bet per line, amount of the total wager, any other factor, or randomly. For example, the player may select from 4 symbols for wagers below 20 credits and select from 6 symbols for wagers above 20 credits.

In addition, the number of symbols offered may differ from game machine to game machine. For example, one game machine may offer the player 3 wild symbols and another may offer 5 wild symbols. In addition, the number of wild symbols may also be a factor of the total number of symbols used in a game.

Any number of wild symbols selected. The present invention allows for selecting any number of wild symbols on each spin. The number of selected wild symbols may vary according one or more factors, such as amount of pay lines wagered upon, amount of bet per line, amount of the total wager, any other factor, or randomly. For example, the player may select 1 symbol (out of 3) on wagers below 20 credits and select 2 symbols (out of 5) for wagers above 20 credits.

In addition, the number of symbols selected may differ from game machine to game machine. For example, one game machine may allow the player to select 2 wild symbols and another may allow the player to select 4 wild symbols.

- Any method of selecting wild symbols. The present invention allows for selection of wild symbols by the player, by a third party, and/or at random.
- Any device for selecting wild symbols. The present invention allows for selection of wild symbols by any device, such as, buttons, virtual buttons, tabs, handles, touch screen, voice, sound, or other physical operation in predetermined and/or other locations.
- Any frequency of selecting wild symbols. The present invention allows for any frequency of selecting wild symbols. For example, wild symbols may be selected each spin; every N-number or predetermined number of spins, with N as a constant integer value or a variable integer value; as optionally determined by wager level, award amounts, pre-determined symbol combinations; and/or optionally at random.
- Any frequency of wild symbols on slot reels. The present invention allows for any frequency of the wild symbols on the slot reels, including equal frequency for all selected and/or displayed symbols and/or imbalanced frequencies for each of the symbols selected and/or displayed on the display. For example, one of the wild symbols may appear more frequently but result in a lower reward (e.g., 1X pay), while another wild symbol may appear less frequently but result in a higher reward (e.g., 5X pay). The present invention also optionally permits any range of symbol frequency in the entire symbol set.
- Any use of wild symbols. The present invention allows for use of the selected wild symbols in any or all pays, including line pays, line scatter pays, reel scatter pays and/or any other form of pay. For example, wild symbols may be used to: replace a line pay symbol, but not replace a scatter pay symbol; replace a scatter pay symbol but not a line pay symbol; replace both scatter and line pay symbols, and the like.

Any award for wild symbols. The present invention allows selected wild symbols to optionally provide one or more types of awards, such as credits, free games, and/or bonus features and events. In addition, the same game may use multiple wild symbols, with each wild symbol possessing its own award type. For example, selected wild symbol 1 acts a wild symbol for all pays and multiplies the value of the winning combination by 5; wild symbol 2 acts a wild symbol for all pays and multiplies the value of the winning combination by 2; and wild symbol 3 just acts as a wild symbol for line pays.

Any method of indicating a wild symbol. The present method of the invention allows for any method of indicating a selected wild symbol to the player, e.g., the symbols for which the player has selected wild during the game. For example, the selected wild symbol may be advantageously highlighted above the symbol matrix and all matching symbols on the reel strips are marked with "Wild" text.

Any location for display of wild symbols. The present invention allows for displaying the selected wild symbols in any location in the game's display area or in a separate display area, such as displaying the selected wild symbol above or below the symbol matrix.

All of these alternative embodiments rely upon the underlying Select-A-Wild concept that enables the player to advantageously select one or more symbols as wild symbols ("Select-A-Wild") from the game symbol set or from a pre-designated set of wild symbols that may or may not be from the game symbol set.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other systems and methods for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The Detailed Description including the description of a preferred structure as embodying features of the invention will be best understood when read in reference to the accompanying figures wherein:

FIGS. 6*a*–*i* illustrate the player-selected pay lines and credits bet per pay line;

FIGS. 10*a*–*i* show an illustrative example of representative displays that may be encountered during a typical bonus game in accordance with the principles of the present invention.

The same reference numerals refer to the same parts through the various figures.

NOTATIONS AND NOMENCLATURE

Figure 1:
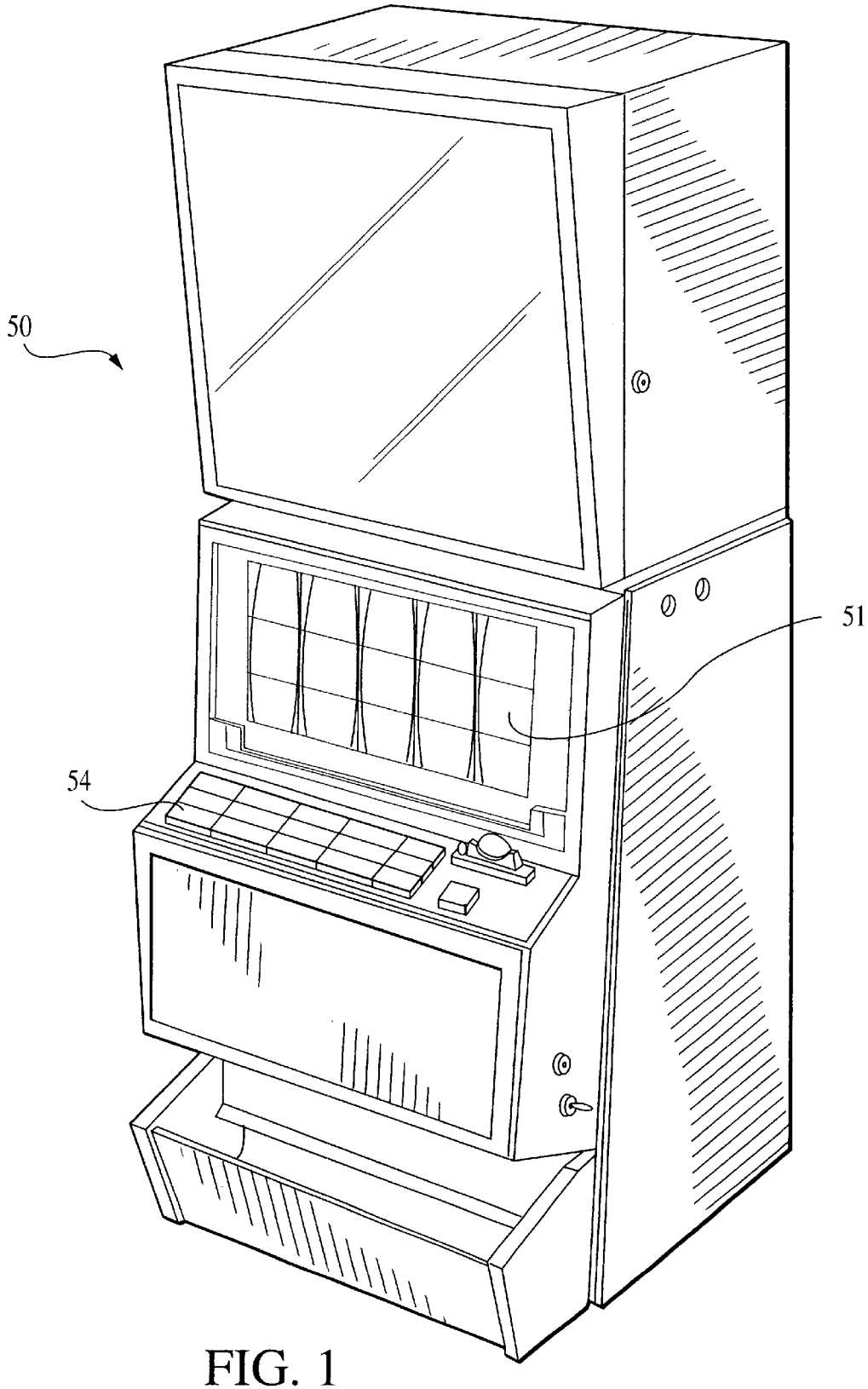
FIG. 1 PRIOR ART
FIG. 1 illustrates a prior art slot machine.
Figure 2:
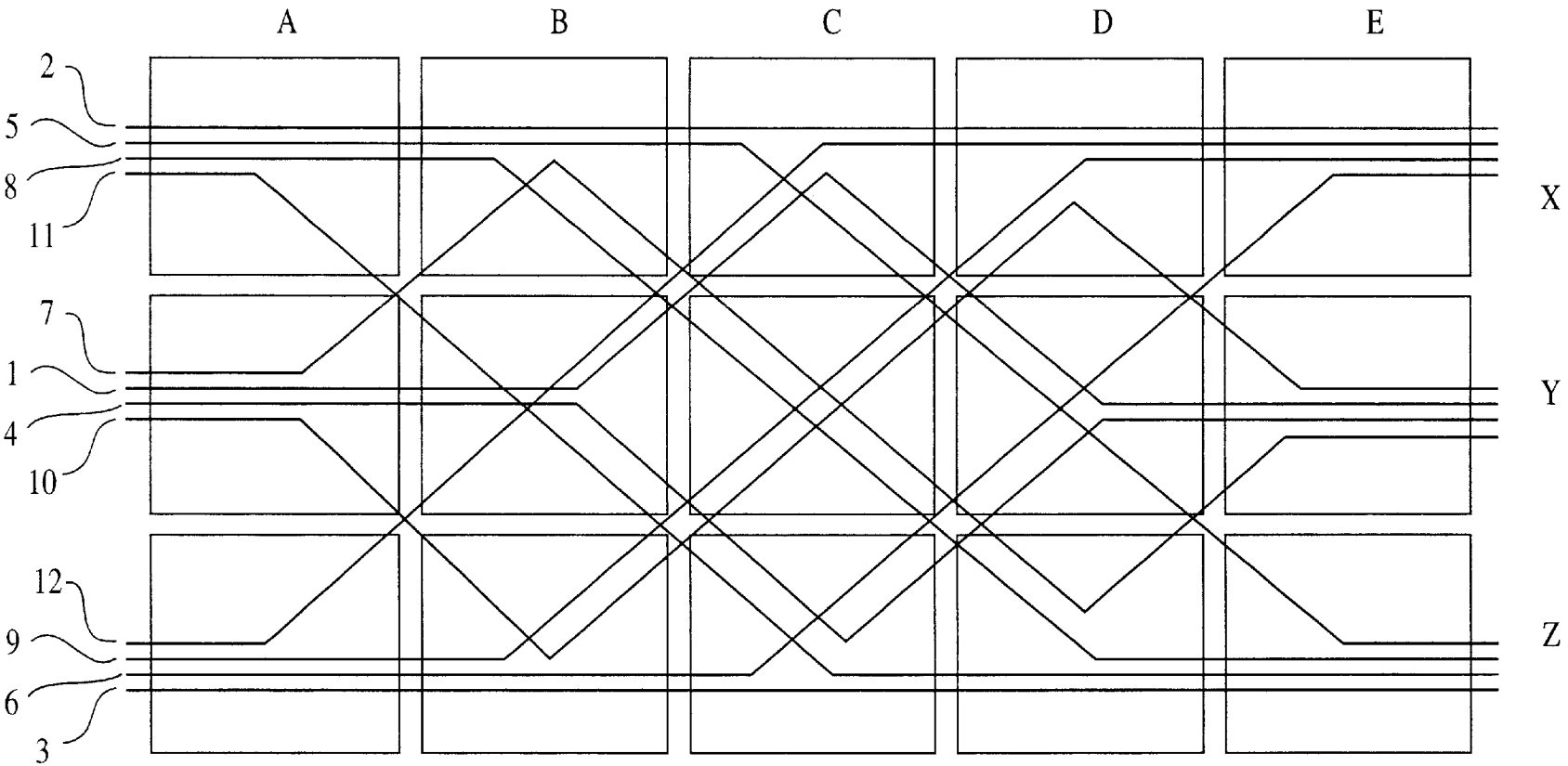
FIG. 2 PRIOR ART
FIG. 2 diagramatically illustrates a prior art 12 line multi-line pay arrangement for a machine with a 3×5 display format.
Figure 3:
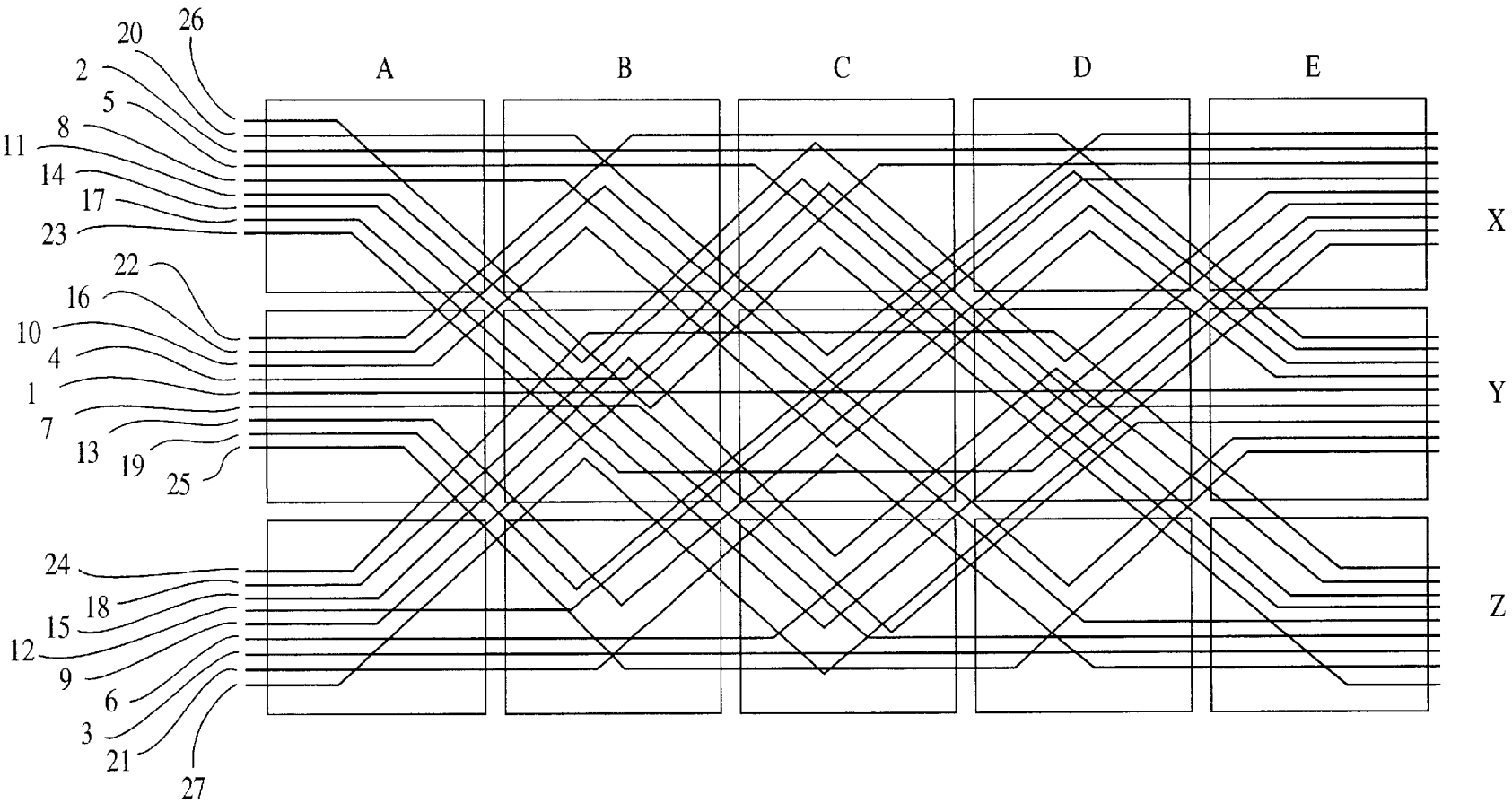
FIG. 3 PRIOR ART
FIG. 3 diagrammatically illustrates a prior art 27 line multi-line pay arrangement for a machine with a 3. times 0.5 display format.

The detailed descriptions which follow may be presented in terms of program procedures executed on a computer or network of computers. These procedural descriptions and representations are the means used by those skilled in the art to most effectively convey the substance of their work to others skilled in the art.

A procedure is here, and generally, conceived to be a self-consistent sequence of steps leading to a desired result. These steps are those requiring physical manipulations of physical quantities. Usually, though not necessarily, these quantities take the form of electrical or magnetic signals capable of being stored, transferred, combined, compared and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary, or desirable in most cases, in any of the operations described herein which form part of the present invention; the operations are machine and/or manual operations. Useful machines for performing the operation of the present invention include general purpose digital computers or similar devices.

The present invention also relates to apparatus for performing these operations. This apparatus may be specially constructed for the required purpose or it may comprise a general purpose computer as selectively activated or reconfigured by a computer program stored in the computer. The procedures presented herein are not inherently related to a particular computer or other apparatus. Various general purpose machines may be used with programs written in accordance with the teachings herein, or it may prove more convenient to construct more specialized apparatus to perform the required method steps. The required structure for a variety of these machines will appear from the description given.

DETAILED DESCRIPTION OF A PREFERRED EMBODIMENT OF THE INVENTION

Reference now will be made in detail to the presently preferred embodiments of the invention. Such embodiments are provided by way of explanation of the invention, which is not intended to be limited thereto. In fact, those of ordinary skill in the art may appreciate upon reading the present specification and viewing the present drawings that various modifications and variations can be made.

For example, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

Figure 5A:
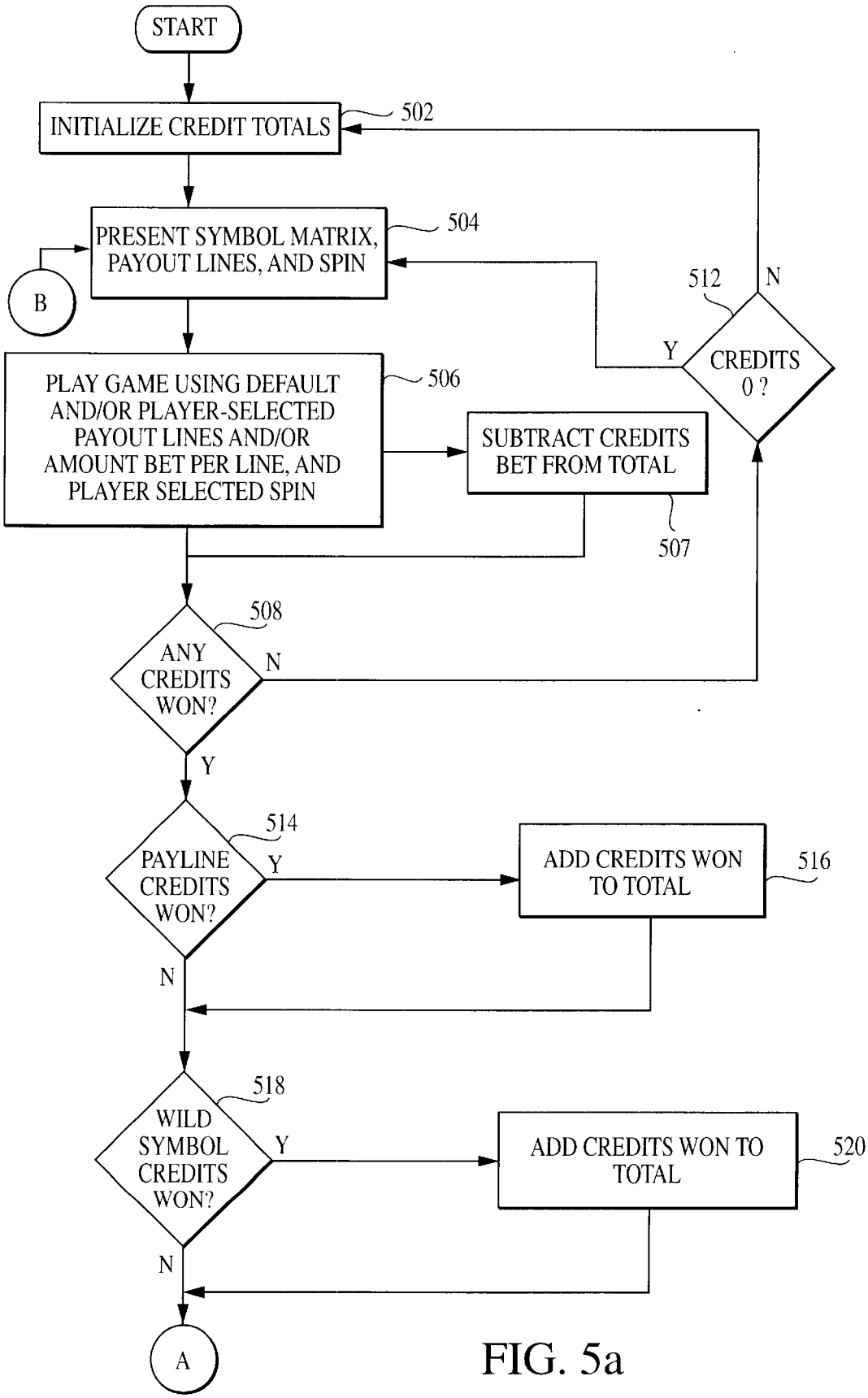
FIGS. 5*a*–5*b*, taken together, is a flowchart depicting a preferred embodiment of the present invention.
Figure 5B:
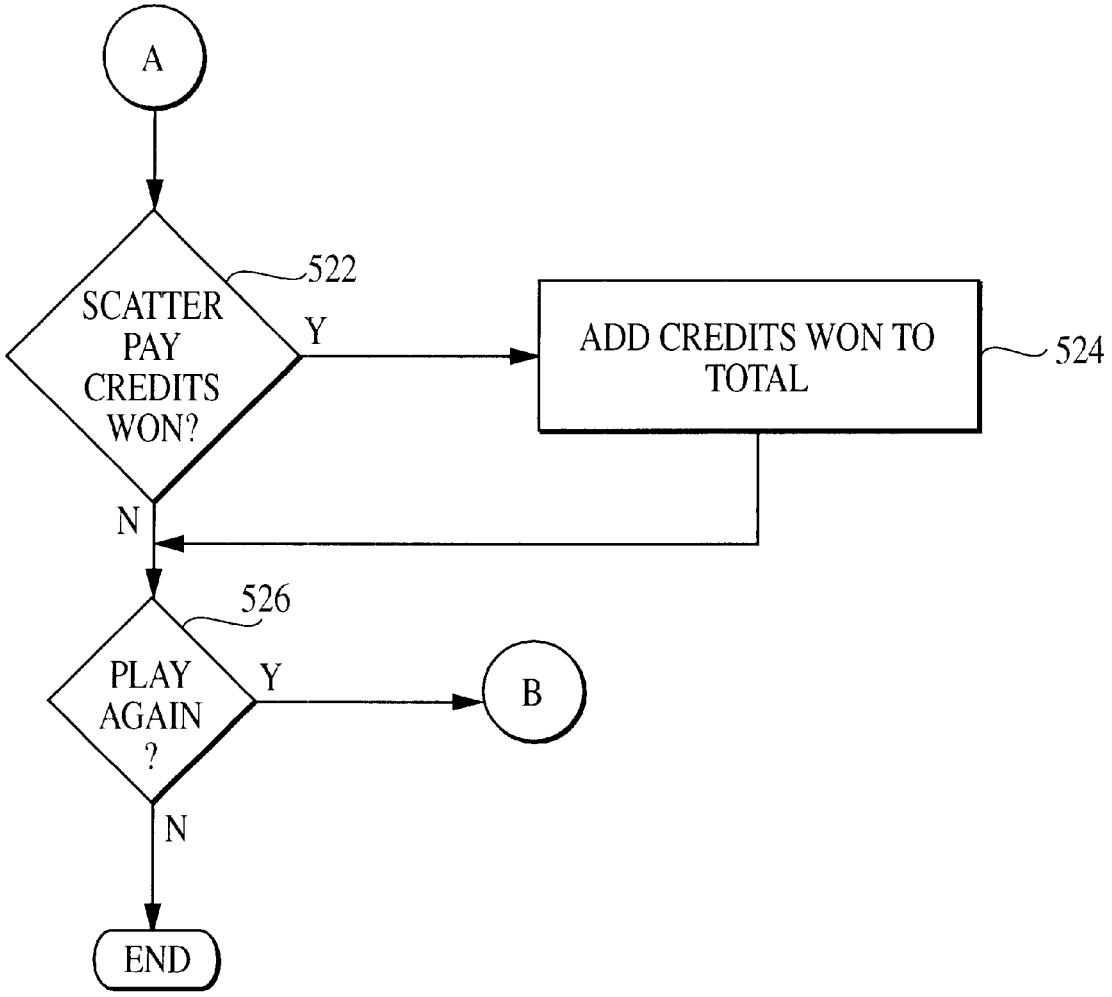

According to the principles of the present invention, a flowchart depicting one example of a process used to implement the game is illustrated in FIGS. 5*a*–5*b*. To begin, the game initializes player credits in accordance with a predetermined amount 502. Virtually any number of initial player credits can be offered. However, it should be kept in mind that in the preferred embodiment, the player can, for example, wager up to 45 credits per play (e.g., 5 paylines at 9 points per payline). Thus, for example, if the player is awarded, say, 90 credits at the start of the game, the game would terminate after the second play unless the player won some additional credits in either the first and/or second play.

Then, the player is presented with a display that presents the player with a symbol matrix, a plurality of paylines that can be selected by the player, and a plurality of spin buttons 504.

In step 506, the player optionally selects one or more of a plurality of paylines and/or an amount bet per payline. Alternatively, the player can accept the default values for the number of paylines and/or the amount bet per payline. The player then selects a spin button to start the game, after either having selected his own payline(s) and/or amount bet per payline, or accepting the default values for each. One of the spin buttons must be selected by the player to start each round of the game. Upon pressing any spin button, the credits bet are subtracted from the player's total 507. Alternatively, the player may select the spin button and while the reels are spinning select a payline and/or amount bet per payline, if not selected by default.

If credits are won as determined in decision step 508, then a determination is made as to whether the credits won are payline credits (e.g., credits won as a result of there being two or more predetermined and/or pre-selected symbols along one or more player-selected paylines) 514. If yes, then the won credits are added to the player's total 516; if no, a test is made in decision step 518 if the credits won are "wild card" credits (e.g., additional payline credits won intuitively, and thus won during play of the main game based on the player's selection of spin button). If yes, then the won credits are added to the player's total 520; if no, a test is made in decision step 522 if the credits won are scatter pay bonus game credits. If yes, then the won credits are added to the player's total 524; if no, the player decides if he wants to play again 526. If yes, the process returns to step 504; if no, the game ends. The process may alternatively determine whether credits are won by determining scatter pays, wild card credits, and/or payline credits in any order.

It should be understood that any combination of the different types of payouts could occur. Thus, for any given round of the game, a player may receive payline credits (as determined at 514), "wild card" credits (as determined at 518), line pay bonus game credits (as determined at 519), and/or scatter pay bonus game credits (as determined at 520), and combinations of two or more of the above.

The preferred embodiment of the present invention includes the play of the base game with Select-A-Wild concept and additional optional bonus features. In alternative embodiments of the present invention, the additional bonus features comprise independent games that may be played by a user, or combination of independent games, that may be used with games other than the base game described herein.

Base Game. To play the base game, the player optionally establishes a pool of credits, optionally selects pay lines, optionally sets the wager per pay line, selects the wild symbol, spins the reels, and collects credits for winning symbol combinations and bonus features.

Figure 4:
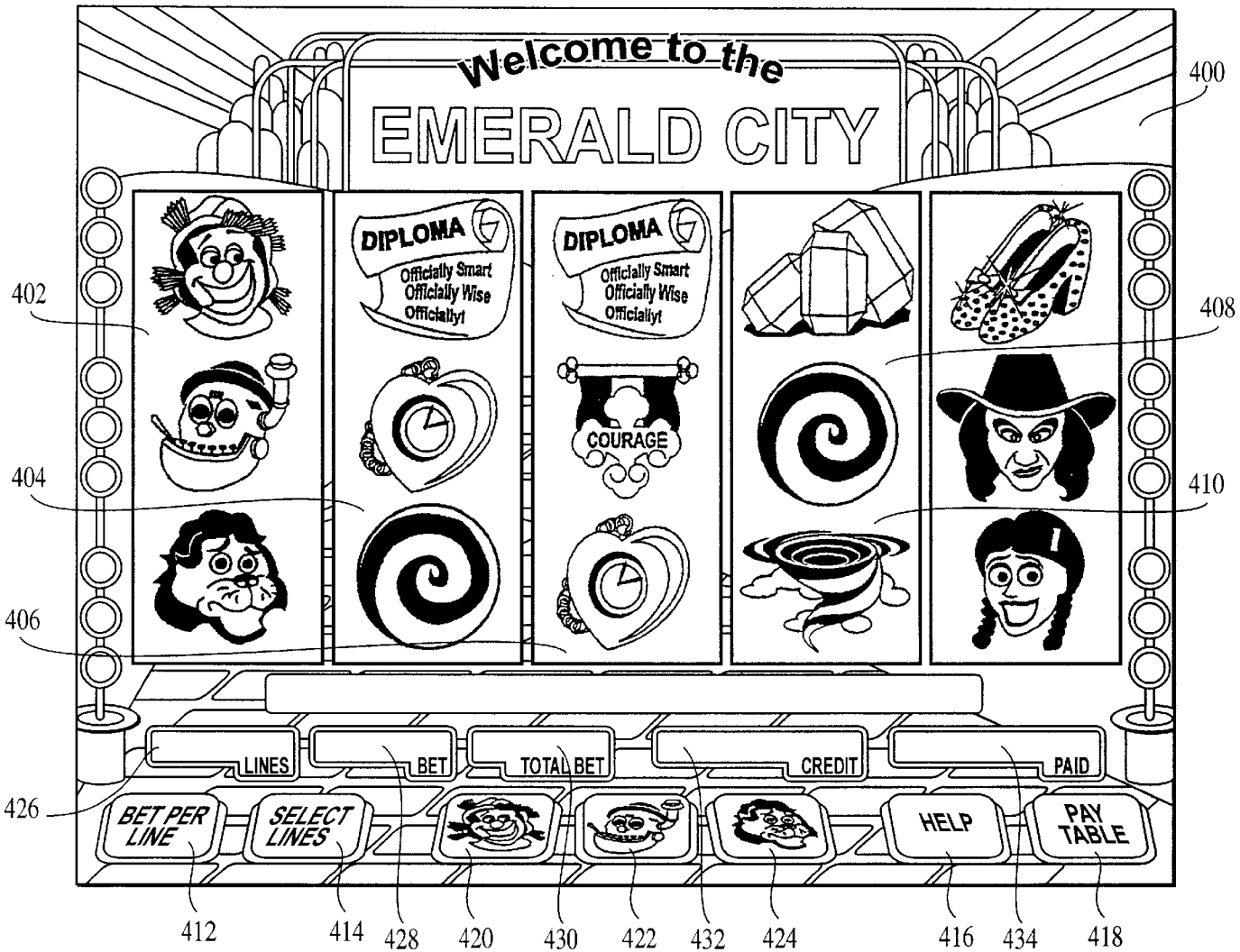
FIG. 4 shows an illustrative example of representative displays that may be encountered during a typical game in accordance with the principles of the present invention.

Video Display. FIG. 4 shows the base game screen 400, including five-reel display using a 5-column by 3-row symbol matrix. The first column 402, second column 404, third column 406, fourth column 408 and fifth column 410 all hold three symbols. Alternatively, the game could utilize any number of columns and reels, such as a 3-column by 3-row symbol matrix.

Buttons. FIG. 4 shows a set of control buttons 412–418 on the base game screen 400 and used by the player to control the functions of the slot game. These buttons include Bet Per Line 412, Select Pay Lines 414, Help 416, and Pay Table 418. Any or all of these control buttons may be displayed on the video display and/or buttons hard wired to the gaming device. If necessary, any number of buttons may be added or removed to further facilitate control of the games.

In addition, three spin buttons 420–424 are also mounted on the button panel. Each spin button has a symbol image printed on the top side of the spin buttons 420–424:

the leftmost button 420 displays a scarecrow;

the middle button 422 displays a tin man; and the rightmost button 424 displays a lion.

The selected spin button is depressed into the button panel and lit up; the unselected spin buttons project out of the button panel and/or are dimmed. Alternatively, one or more of the above buttons may be used to provide the appropriate selections by the player. The buttons may be alternatively switches, touch screen areas, menus or other functionality to provide player selection.

Meters. FIG. 4 shows a set of meters 426–434 on the base game screen 400 and used to display the salient information for the game, including Number of Pay Lines 426, Amount Bet Per Line 428, Total Bet 430, Credits, 432 and Paid 434:

The Number of Pay Lines meter 426 is associated with the Select Pay Lines button and displays the current number of Pay Lines Selected.

The Amount Bet Per Line 428 meter is associated with the Bet Per Line button and displays the number of credits wagered per pay line.

The Total Bet 430 meter displays the cumulative value of the Number of Pay Lines and Amount Bet Per Line.

The Credits meter 432 which displays the total number credits remaining in the credit pool.

The Paid meter 434 displays the number of credits won on the last spin.

Any number of meters may optionally be used, depending on available games to the player to play, for example, pay lines, number of credits, and the like.

Credit Pool. FIG. 4 shows the number of credits in the credit pool, as displayed on the Credits meter 432. The pool of credits increases and decreases according to the player's wins or losses and may be supplemented, if necessary, by the player by additional deposits of coins, tokens or paper currency.

Figure 6A:
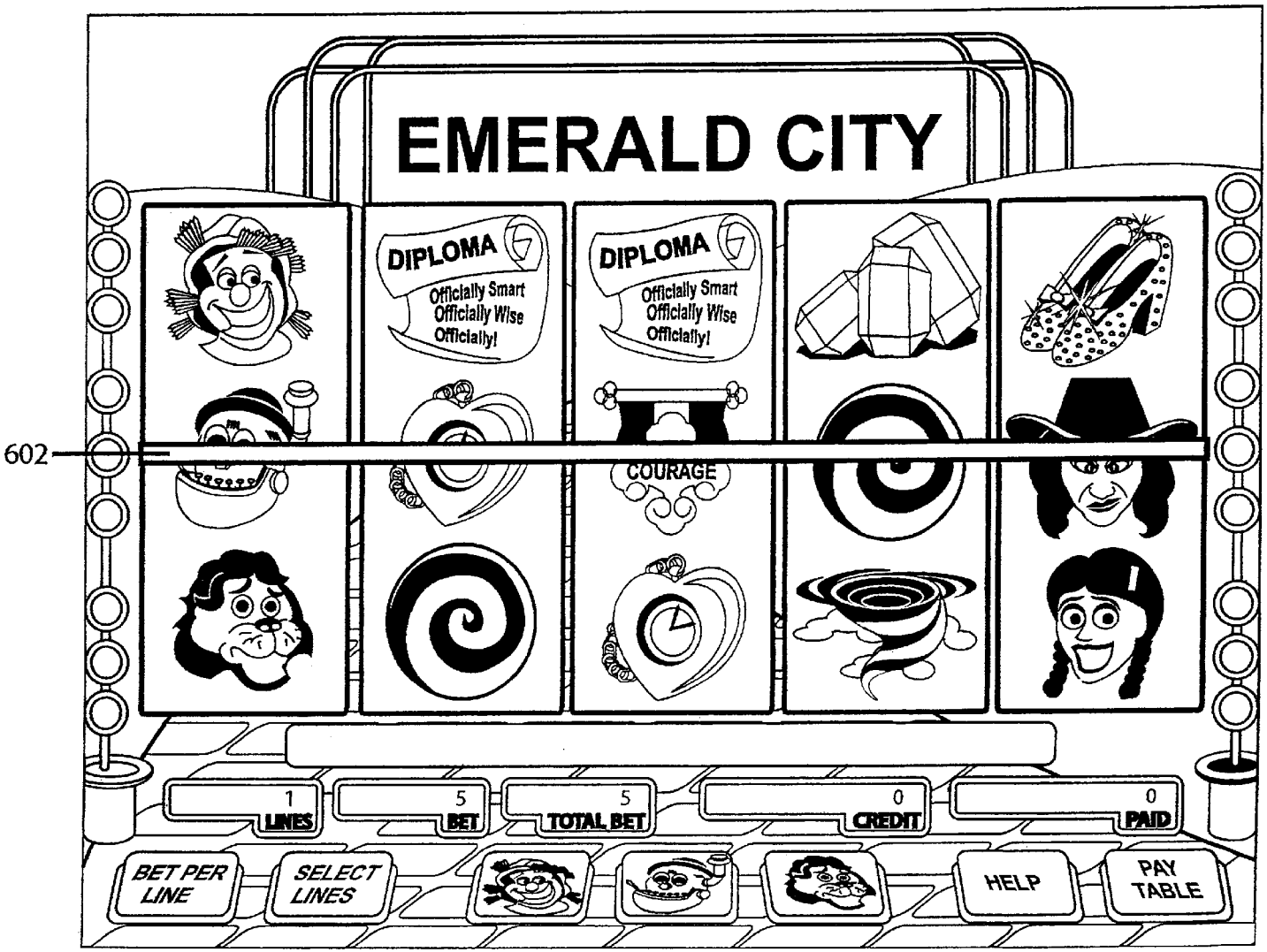
Figure 6B:
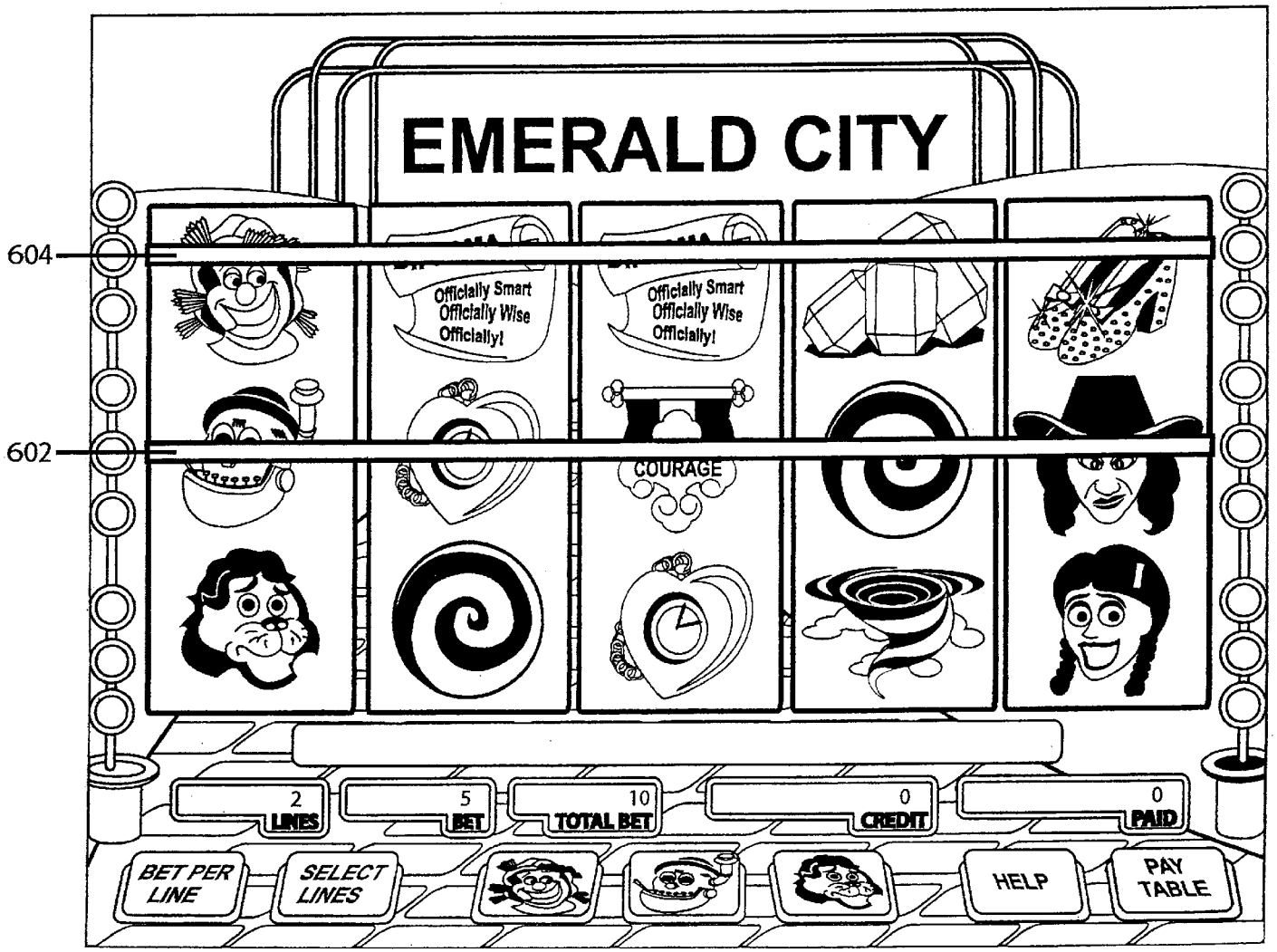
Figure 6C:
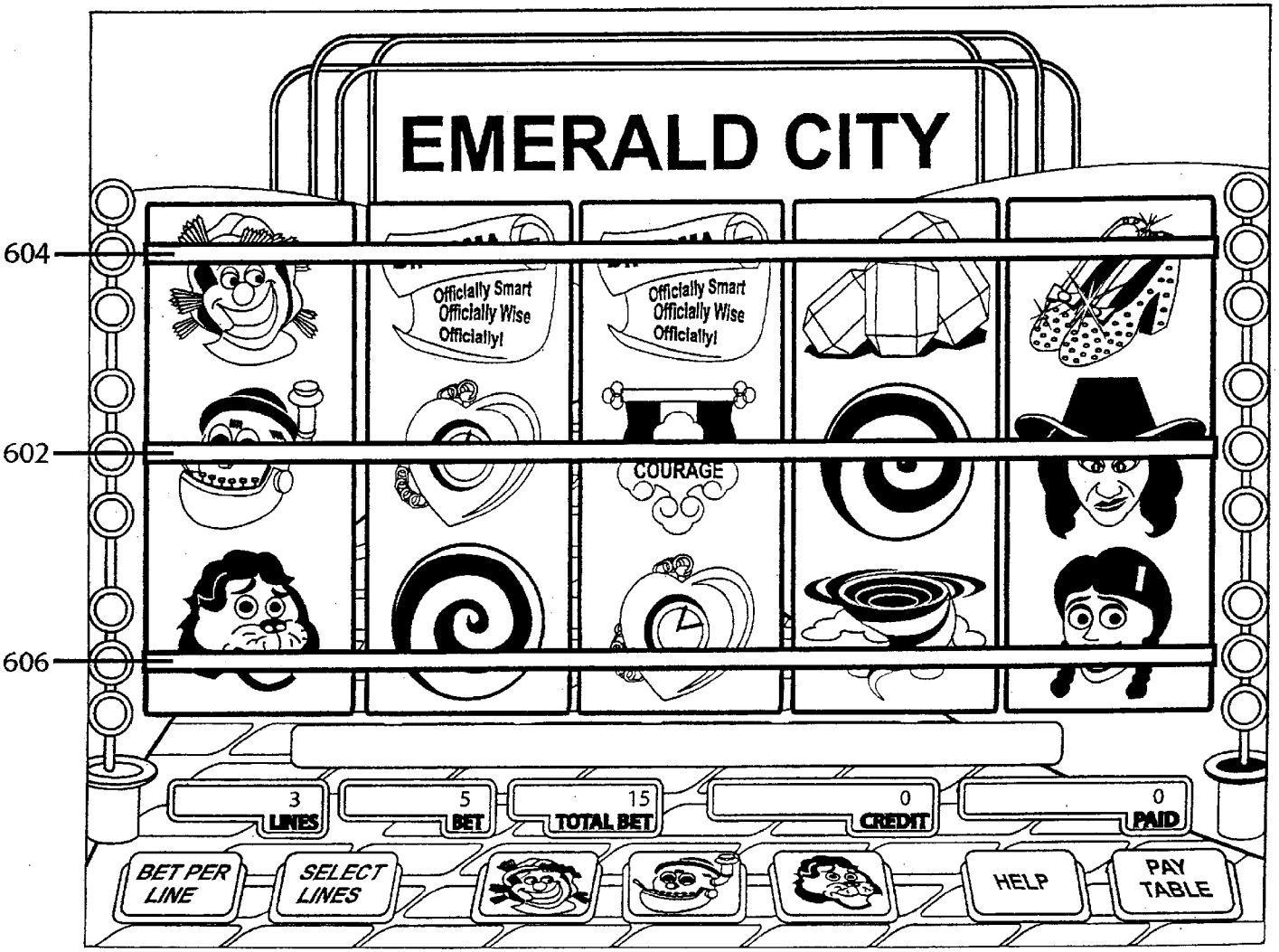
Figure 6D:
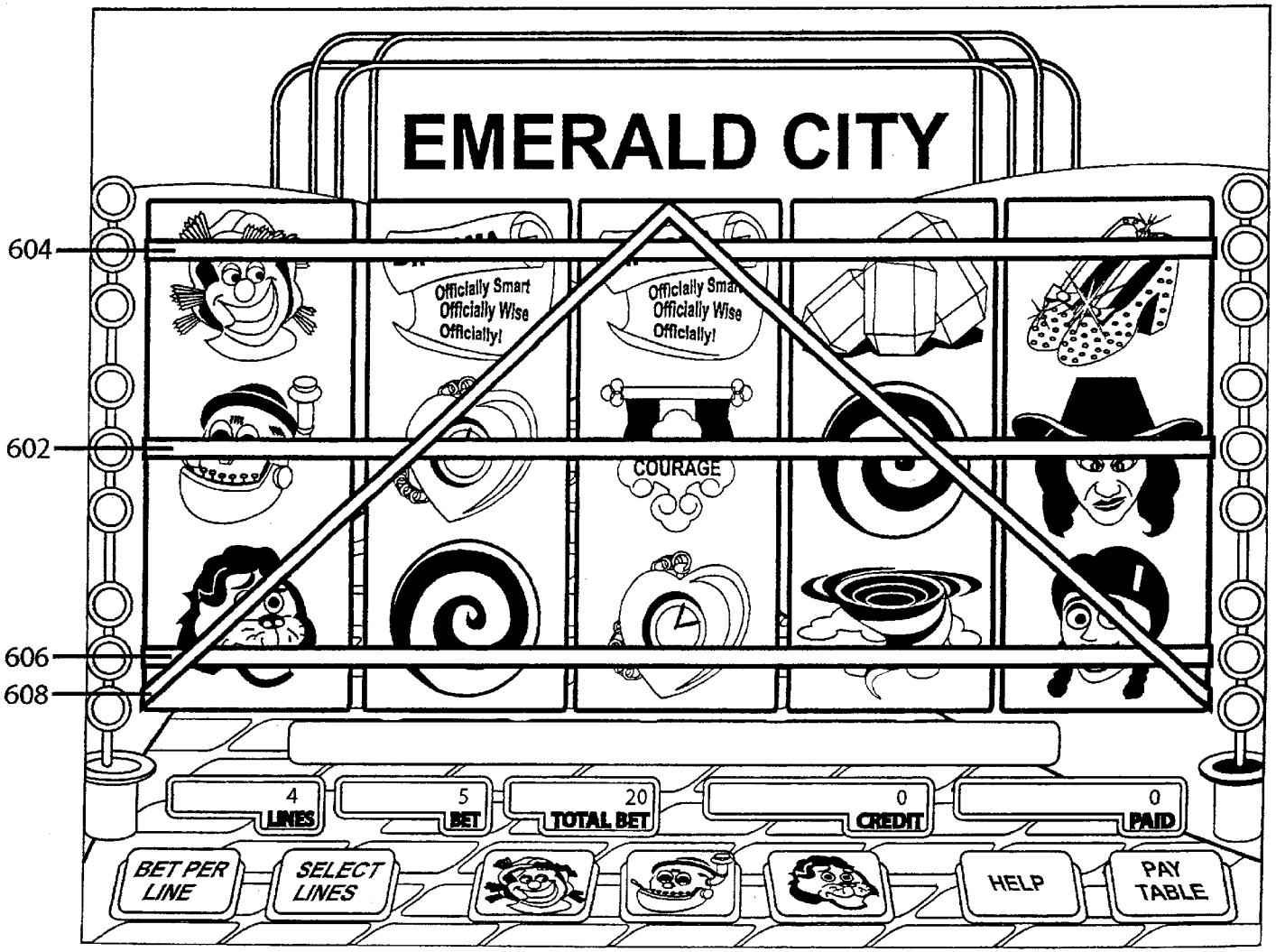
Figure 6E:
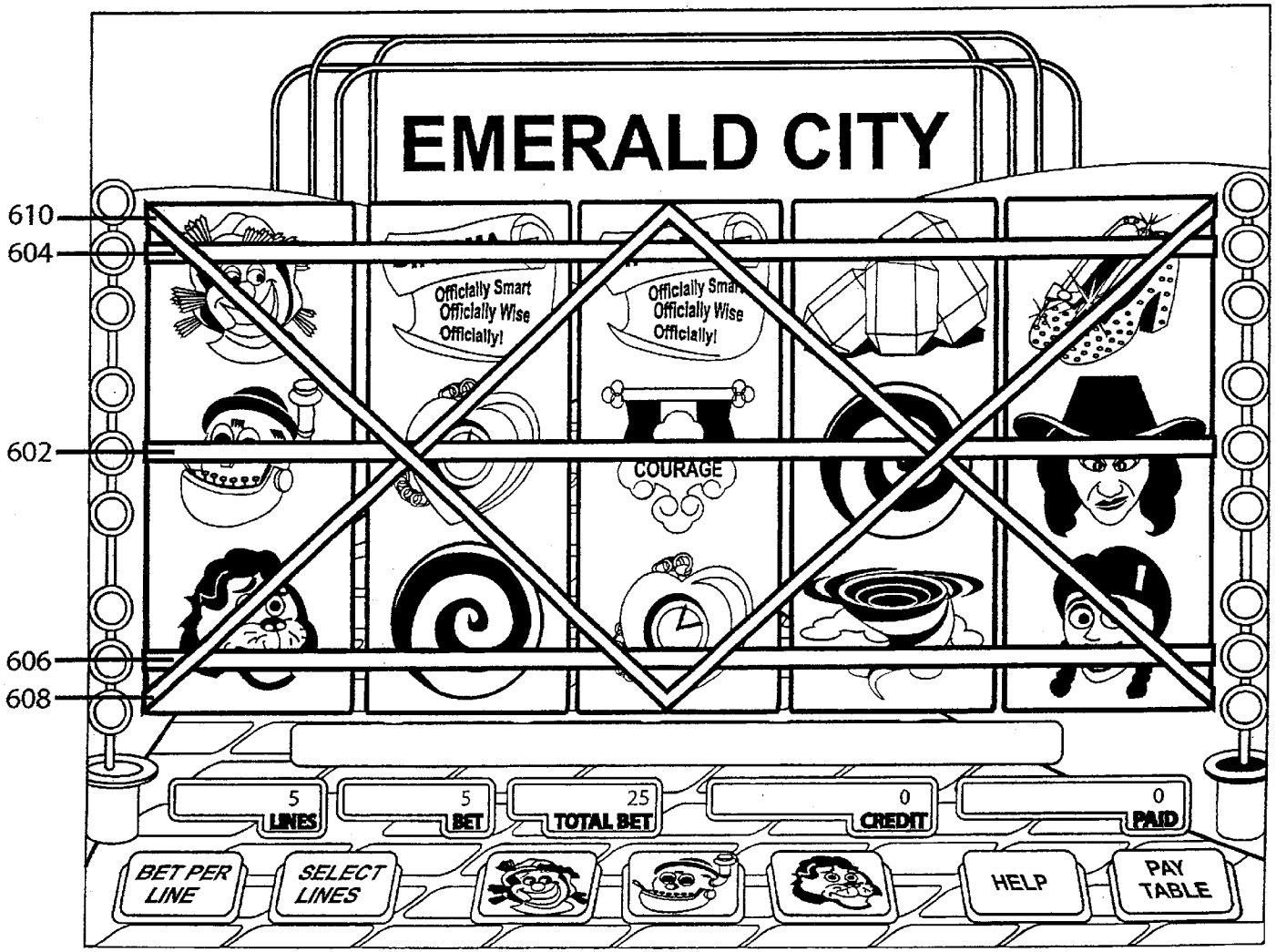
Figure 6F:
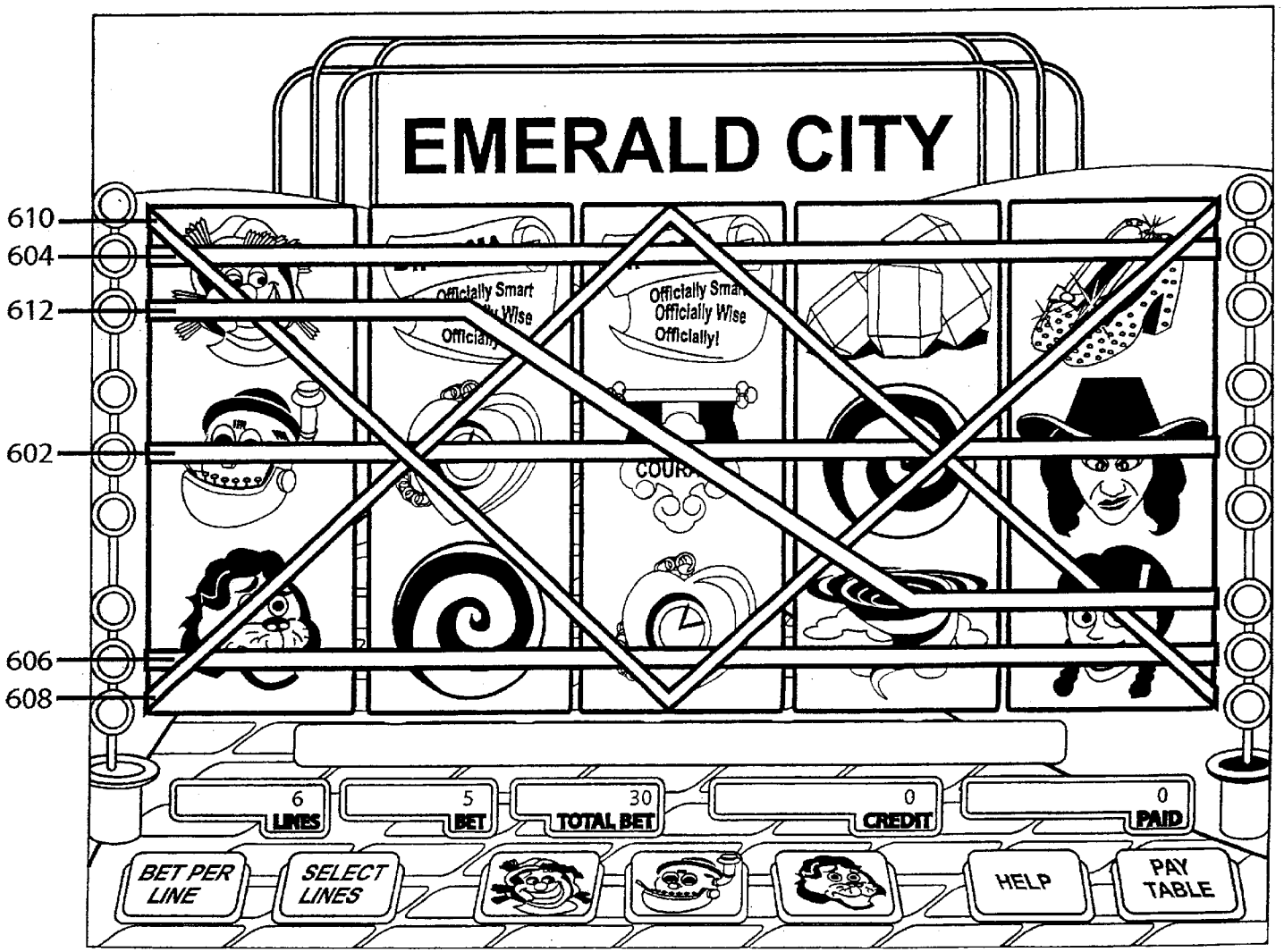
Figure 6G:
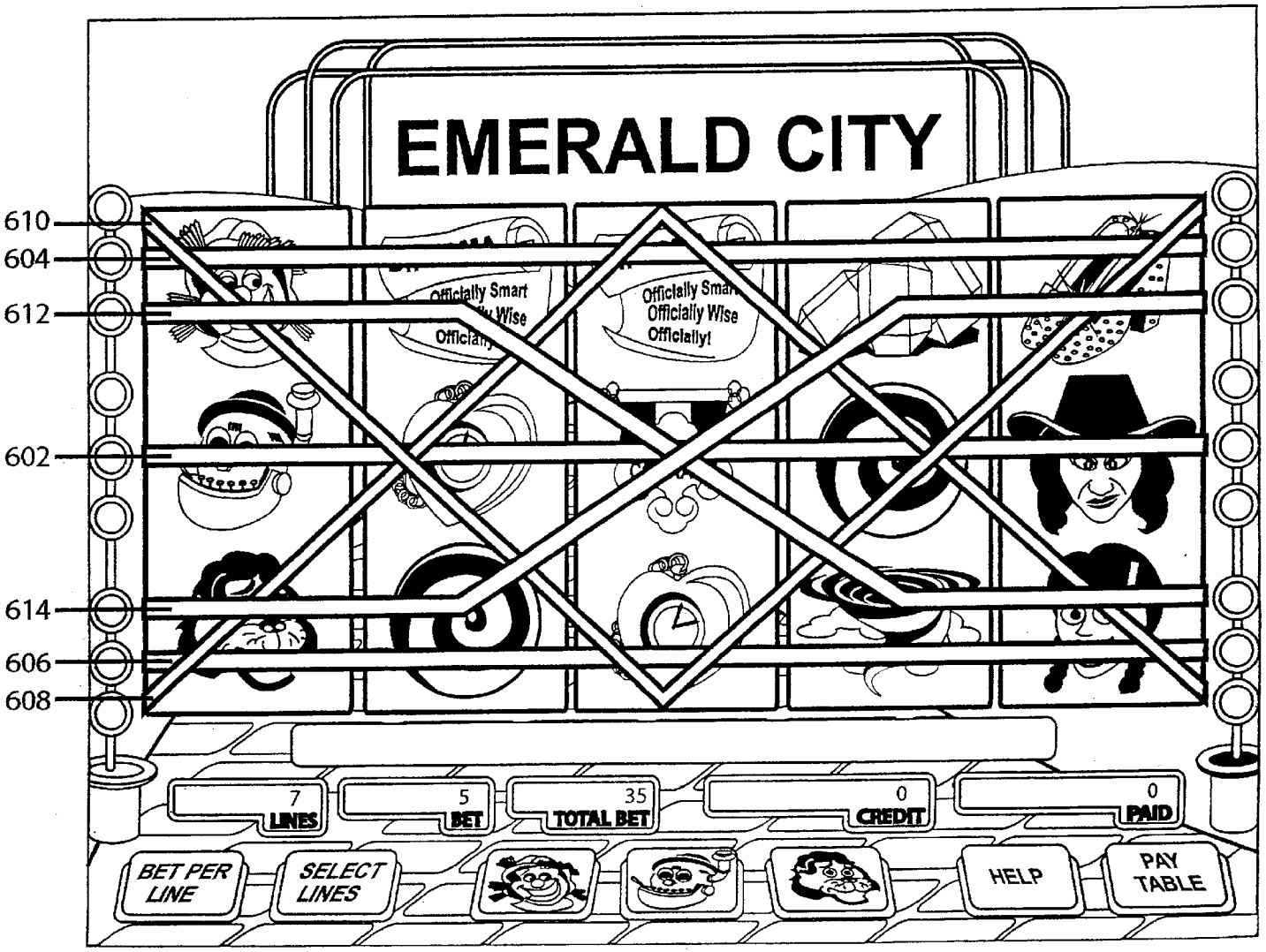
Figure 6H:
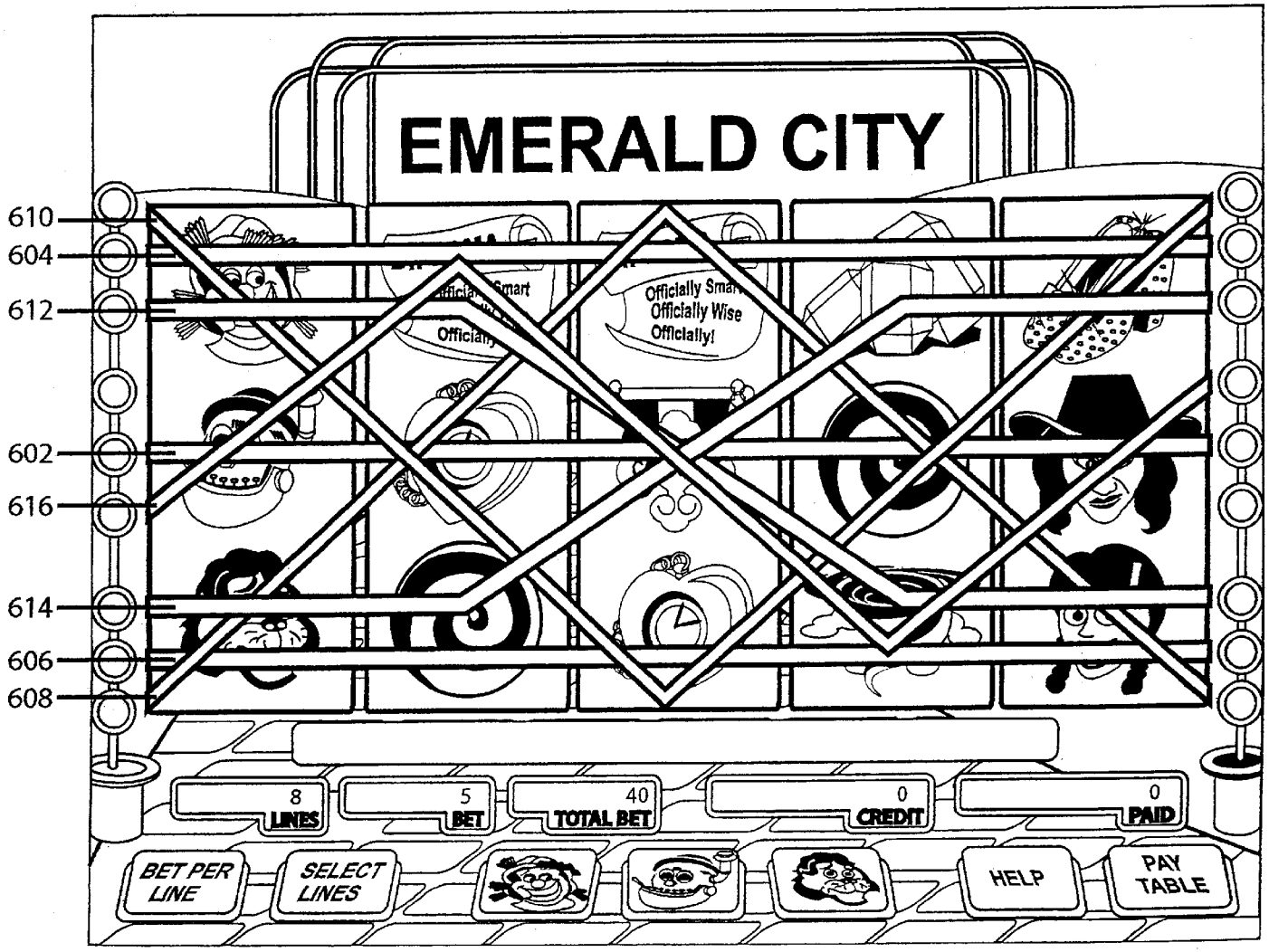
Figure 61:
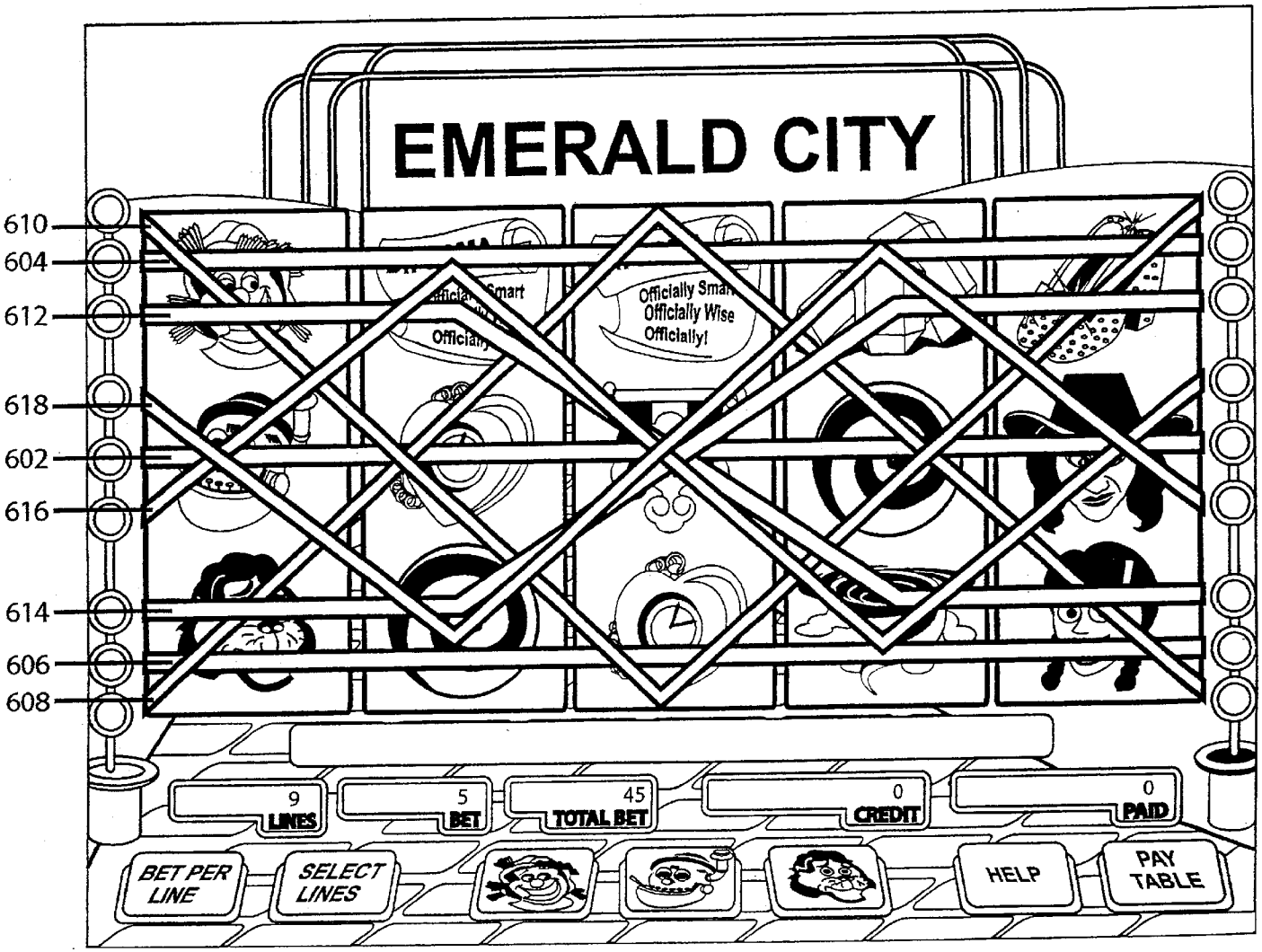

Select Pay Lines. FIGS. 6*a–i* show the plurality of pay lines 602–618 upon which to wager. The pay lines wagered upon by the player activate in a predetermined order, as follows:

FIG. 6*a* shows the player's first wager is applied to pay line 1 602;

FIG. 6*b* shows the second wager is applied to pay line 2 604;

FIG. 6*c* shows the third wager is applied to pay line 3 606;

FIG. 6*d* shows the fourth wager is applied to pay line 4 608;

FIG. 6*e* shows the fifth wager is applied to pay line 5 610;

FIG. 6f shows the sixth wager is applied to pay line 6 612;

FIG. 6*g* shows the seventh wager is applied to pay line 7 614;

FIG. 6*h* shows the eighth wager is applied to pay line 8 616; and

FIG. 6*i* shows the ninth wager is applied to pay line 9 618.

However, the games may utilize any other order of pay line activation and fewer or greater than nine pay lines may be used. The number of pay lines selected is displayed on the Number of Pay Lines meter 620. Alternatively, pay lines do not have to be used at all.

Bet Per Line. FIGS. 6*a–i* show the number of credits in wagered on each pay line, as displayed on the Bet Per Line meter 622. The same amount is wagered on each pay line. Alternatively, the player could be allowed to make wagers of different amounts on each pay line. The total amount wagered is determined by summing the amounts wagered on each pay line. Alternatively, no wager is required.

Total Bet. FIGS. 6*a–i* show the total number of credits bet on all of the pay lines, as displayed on the Total Bet meter 624. The total bet is calculated by multiplying the value of the Number of Pay Lines meter 620 by the Bet Per Line meter 622.

Figure 7A:
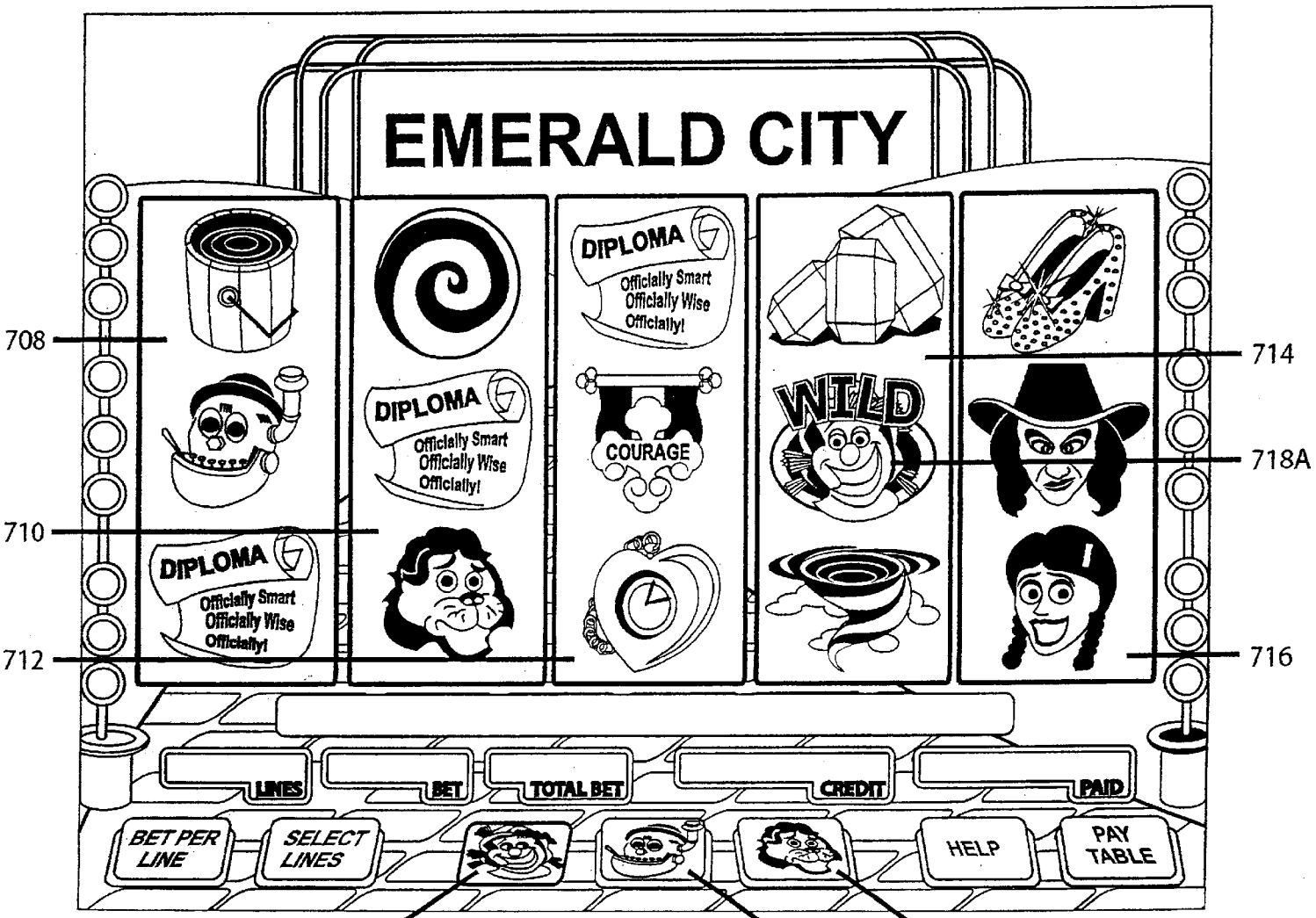
FIGS. 7*a*–7*c* illustrate different player-selected buttons and wild symbols within the display.
Figure 7B:
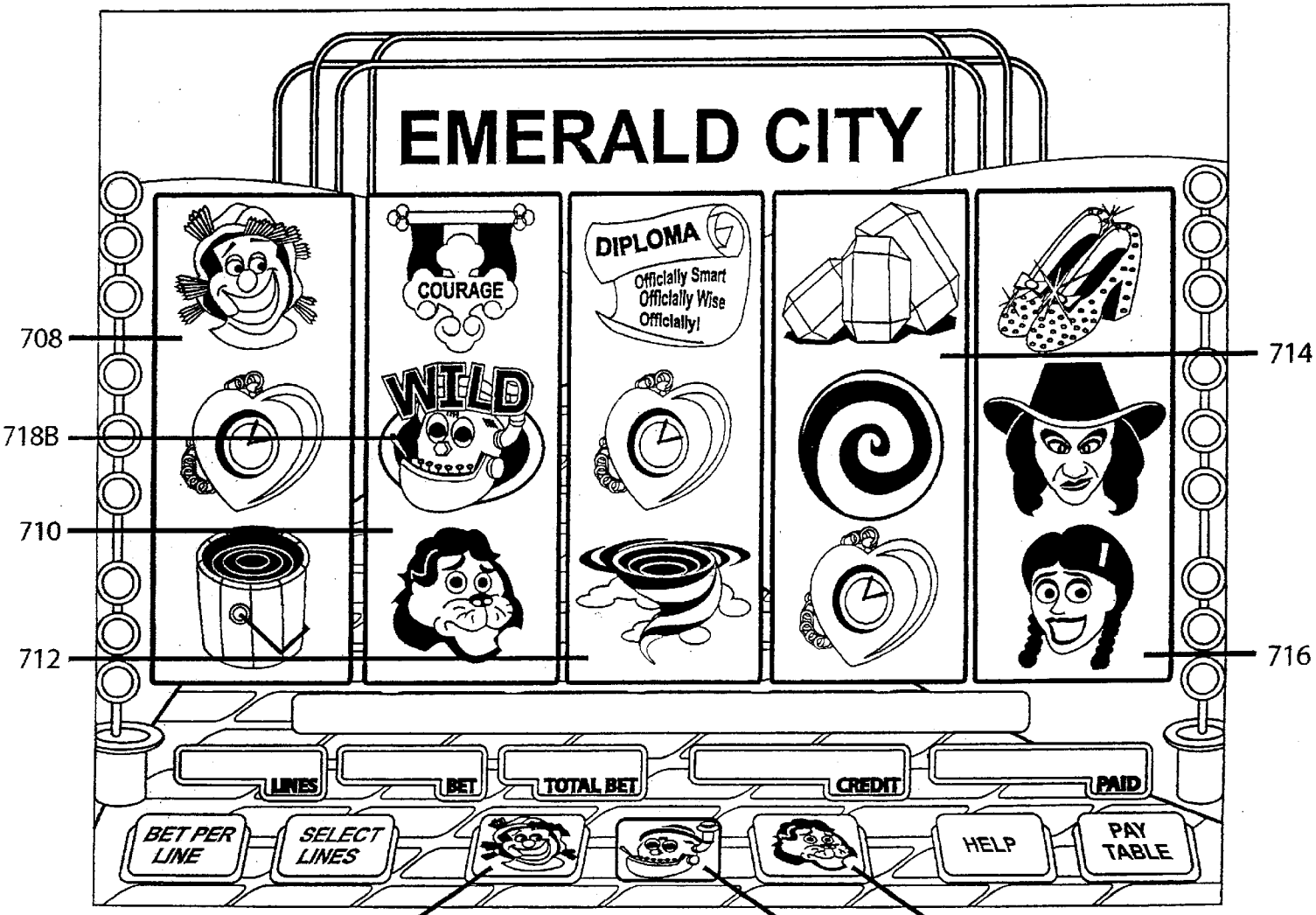
Figure 7C:
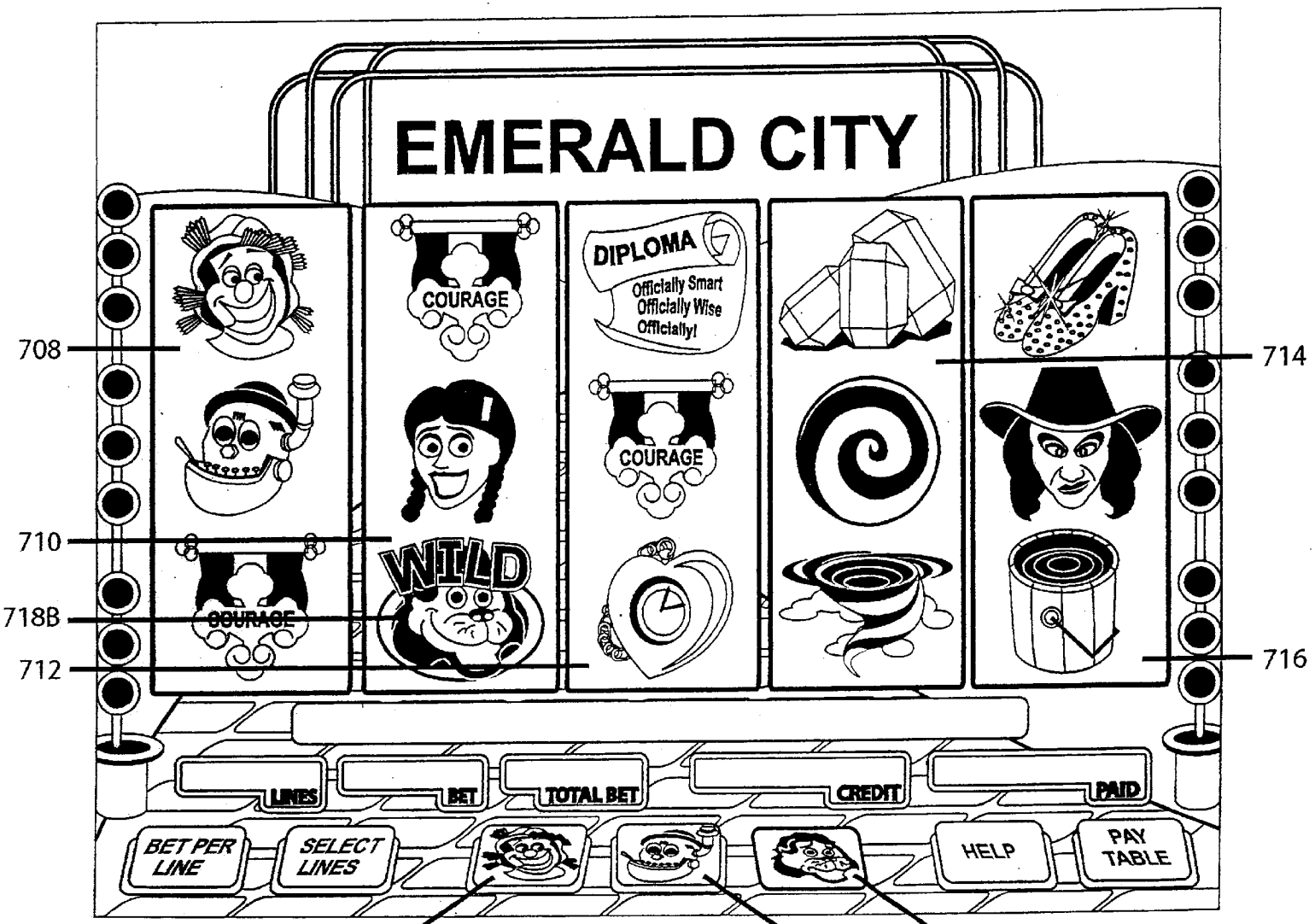

Select Wild Symbol & Spin Reels. FIGS. 7*a–c* show the three spin buttons 702–706, along with associated symbols, that allow the player to select a wild symbol 718*a–c* and make the slot machine reels 706–716 to spin. This can be done in any suitable manner, such as the player pressing a "spin" button on the machine's button panel and watching a video simulation of a reel slot machine. Alternatively, the selection may be done automatically by the machine, predetermined, pre-selected of other standard selections.

FIG. 7*a* shows the player's selection of the scarecrow button 702 as wild and resulting spin in which the scarecrow wild symbol 718*a* appears in the fourth slot reel 714.

FIG. 7*b* shows the player's selection of the tin man button 702 as wild and resulting spin in which the tin man wild symbol 718*b* appears in the second slot reel 710.

FIG. 7*c* shows the player's selection of the lion button 702 as wild and resulting spin in which the lion wild symbol 718*c* appears in the second slot reel 710.

Figure 8:
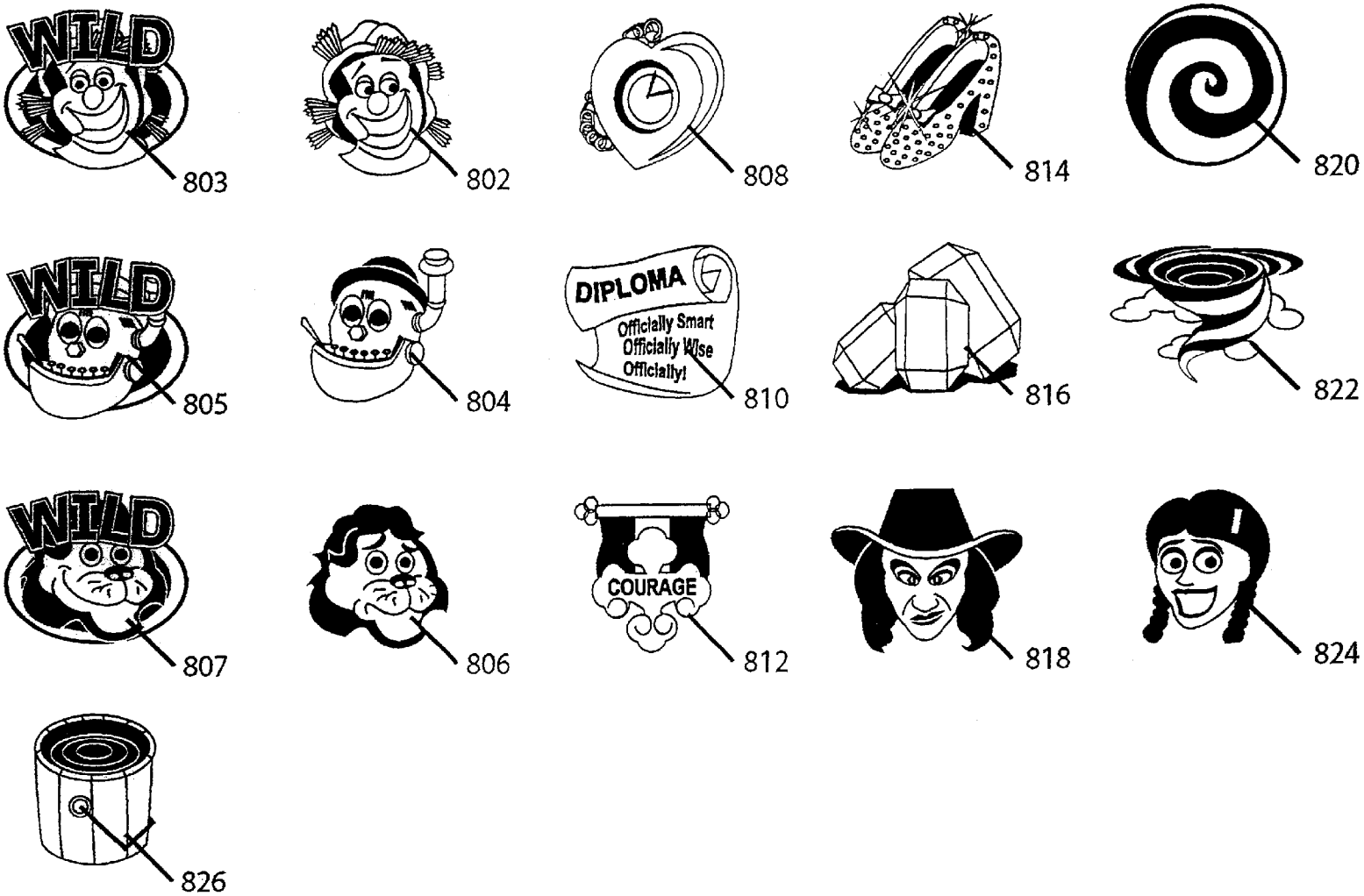
FIG. 8 illustrates the symbol set.

Symbol Set. FIG. 8 shows a set of thirteen symbols: scarecrow 802, tin man 804, lion 806, heart 808, diploma 810, courage 812, shoes 814, gems 816, witch 818, swirl, 820, tornado 822, girl 824, and bucket 826. In addition, FIG. 8 also shows the "wild" states of the scarecrow symbol 803, tin man symbol 805 and lion symbol 807, as they appear on the slot reels when selected as the wild symbol.

For each spin, the machine randomly displays three symbols 802–826 from the symbol set on each of the slot reels. A common theme can be used for symbols, and in one embodiment, the symbols are related to an "Emerald City" theme. However, any suitable symbols may be used, including the traditional fruit symbols that commonly appear on other slot machines. Furthermore, fewer or greater than thirteen symbols may be used as a symbol set.

The symbol set is divided into three groups: 9 base symbols 808–824, 3 select-a-wild symbols (also function as select-a-scatter symbols) 802–806, and 1 repeating scatter symbol 826:

Base Symbols 808–824—The nine base symbols provide line pays for, for example, three or more same symbols appearing on an active pay line, from the leftmost pay line position towards the right. Alternative pay line awards may optionally or in addition be used.

Select-a-Wild Symbols 802–806—The two unselected select-a-wild symbols are used as line pay symbols (same as base symbols); the selected wild symbol is wild for the spin and helps form line pays.

In addition, the selected wild symbol also optionally operates as a select-a-scatter symbol. Any three or more selected wild symbols appearing an active pay line trigger a select-a-scatter bonus game. (See Bonus Features—Select-A-Scatter Pay bonus game.)

Repeating Scatter Symbol 826—Any two repeating scatter symbols in the symbol matrix trigger an optional repeating scatter pay bonus game. (See Bonus Features—Repeating Scatter Pay bonus game.)

Figure 9A:
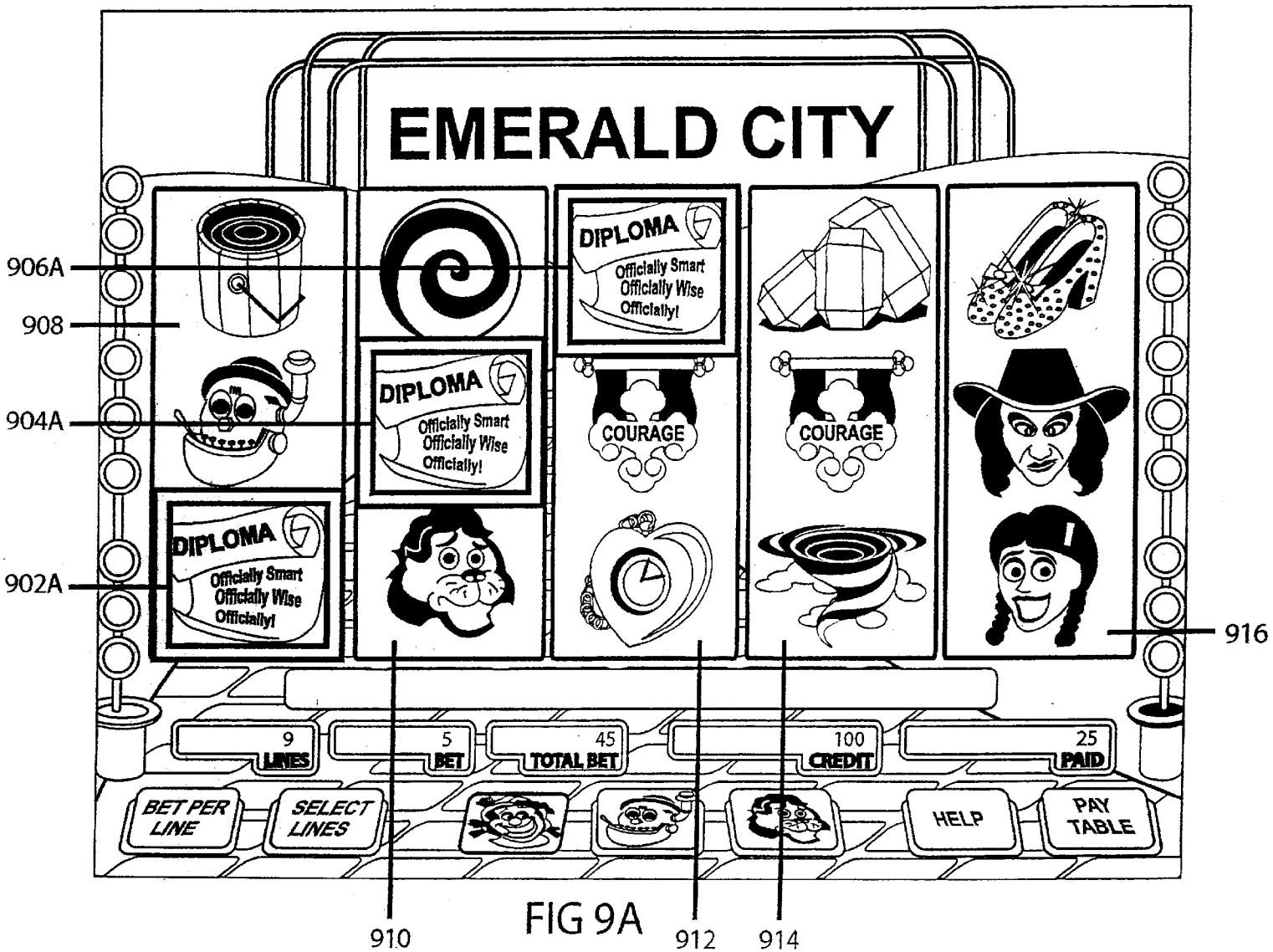
FIGS. 9*a*–9*f* show an illustrative example of representative displays that may be encountered during a typical base game in accordance with the principles of the present invention.
Figure 9B:
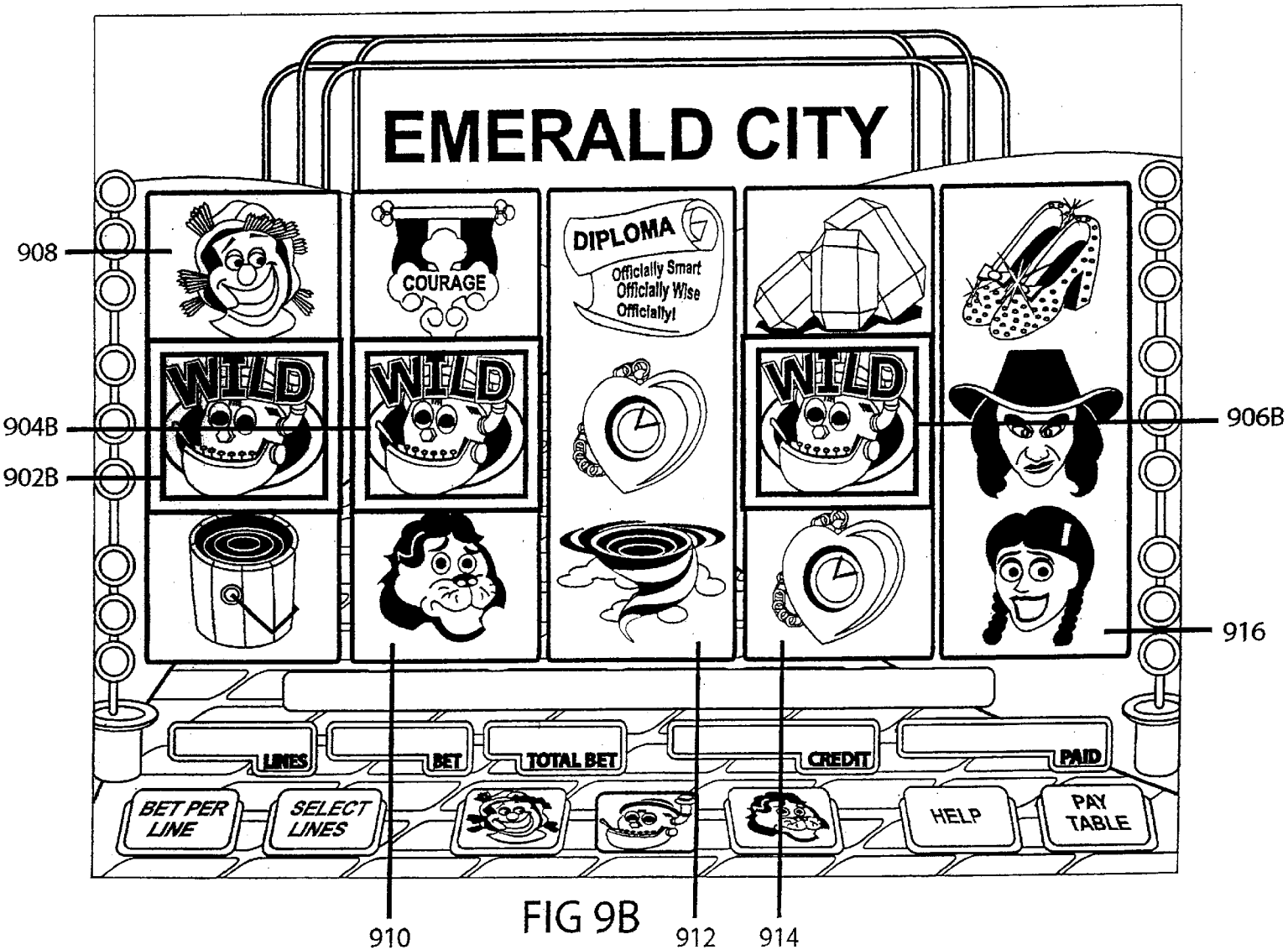
Figure 9C:
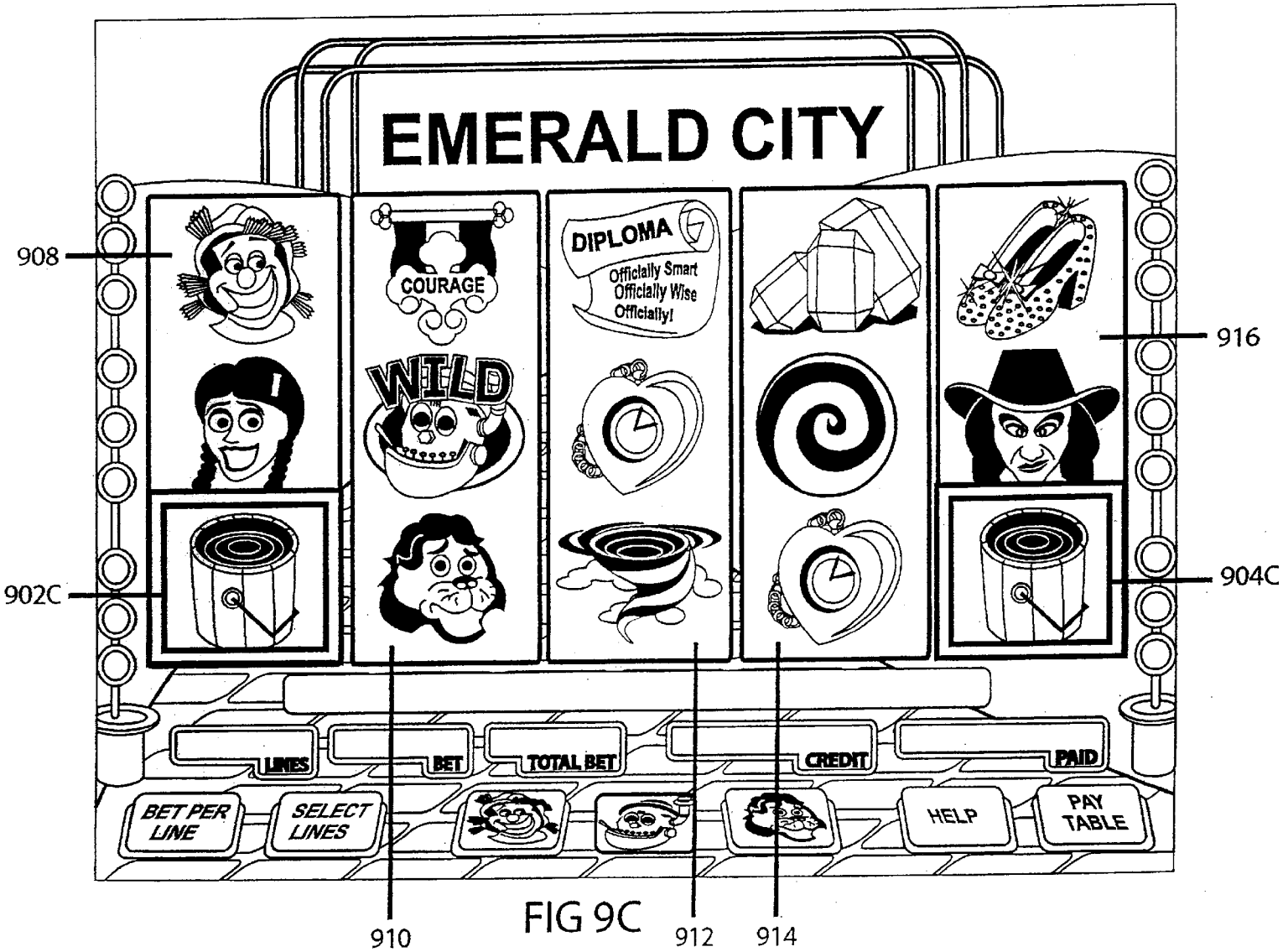

Winning Symbol Combinations. FIGS. 9*a–c* show winning symbol combinations, including line pays 9*a*, line-scatter pays 9*b* and reel-scatter pays 9*c:*

FIG. 9*a* shows a line pay of three Diploma symbols 902*a*–906*a* on the slot reels 908, 910 and 912. In general, line pays involve two or more of the same, base game symbols that appear adjacent to each other reading from the leftmost position of a pay line to the rightmost position.

FIG. 9*b* shows a line-scatter pay of three Tin Man 902*b*–906*b* on the slot reels 908, 910 and 914. In general, line-scatter pays involve two or more of the same line-scatter pay symbols that appear anywhere on an active pay line (e.g., Select-A-Scatter symbols and bonus game).

FIG. 9*c* shows a reel-scatter pay of two Bucket symbols 902*c* and 904*c* on the slot reels 908 and 916. In general, Reel scatter pays involve one or more same symbols that appear in any position in the symbol matrix (e.g., Repeating scatter symbols and bonus game).

Alternatively, any pre-determined arrangement of symbols may be designated as winning symbol combinations.

Figure 9D:
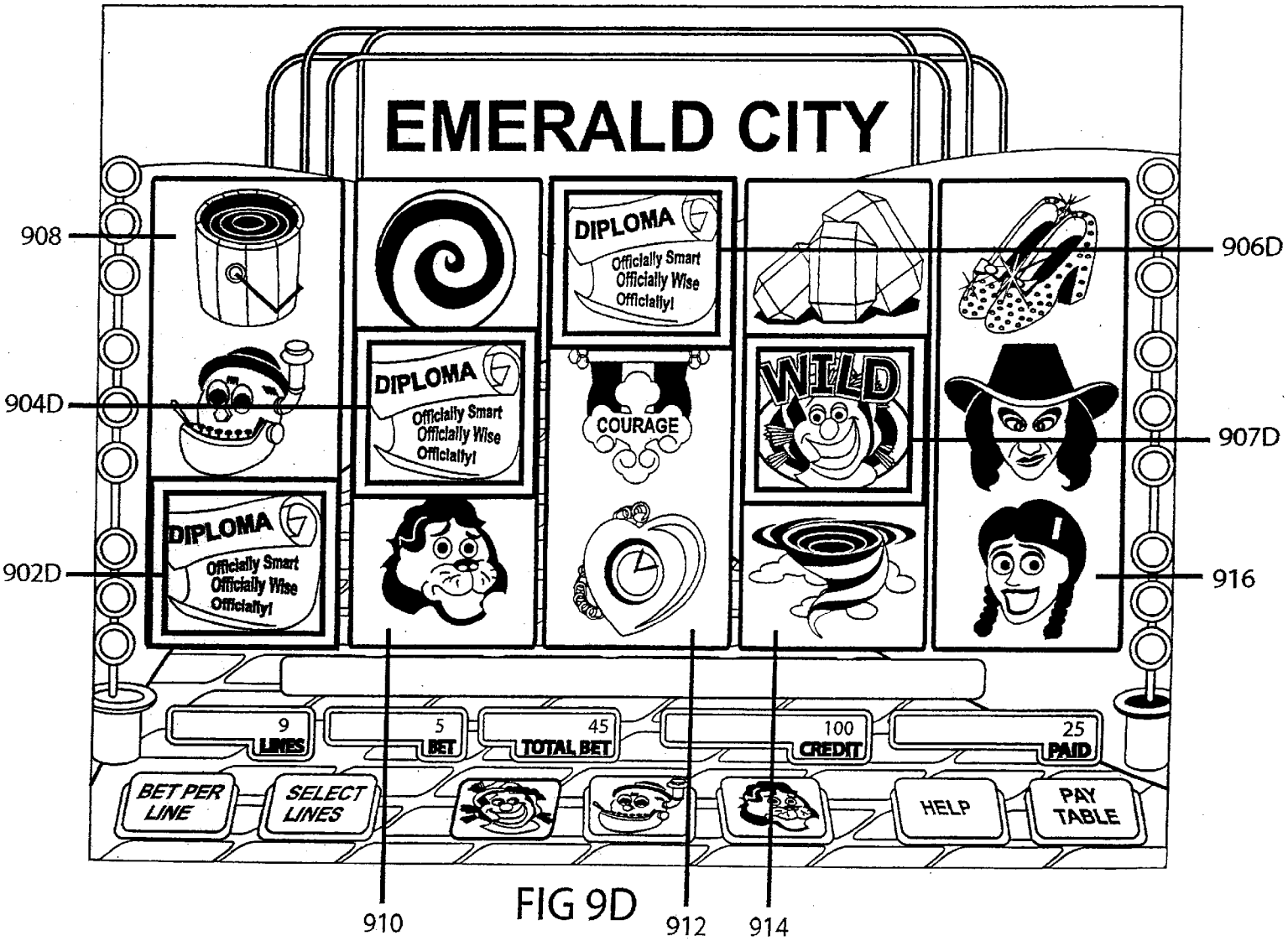
Figure 9E:
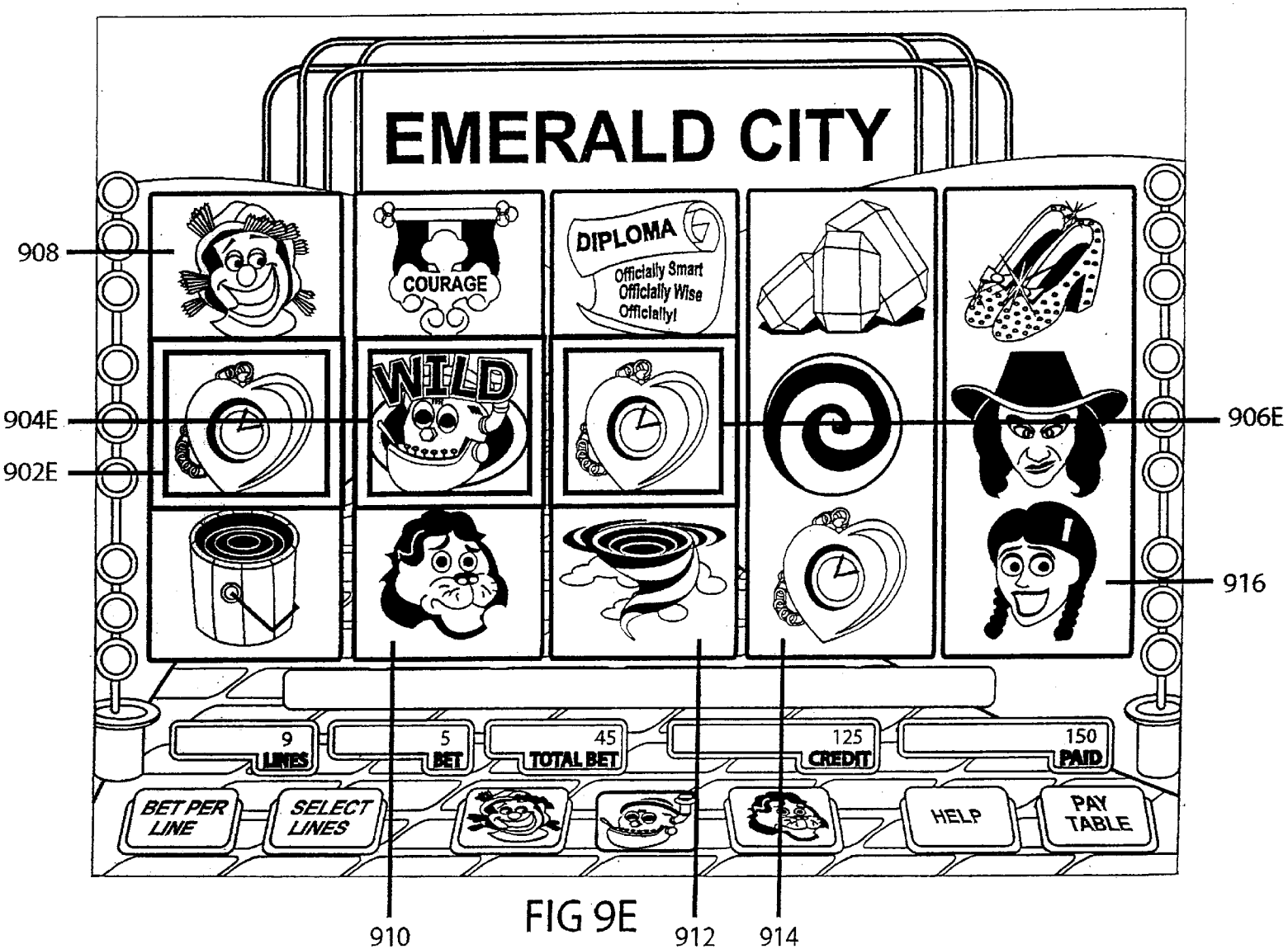
Figure 9F:
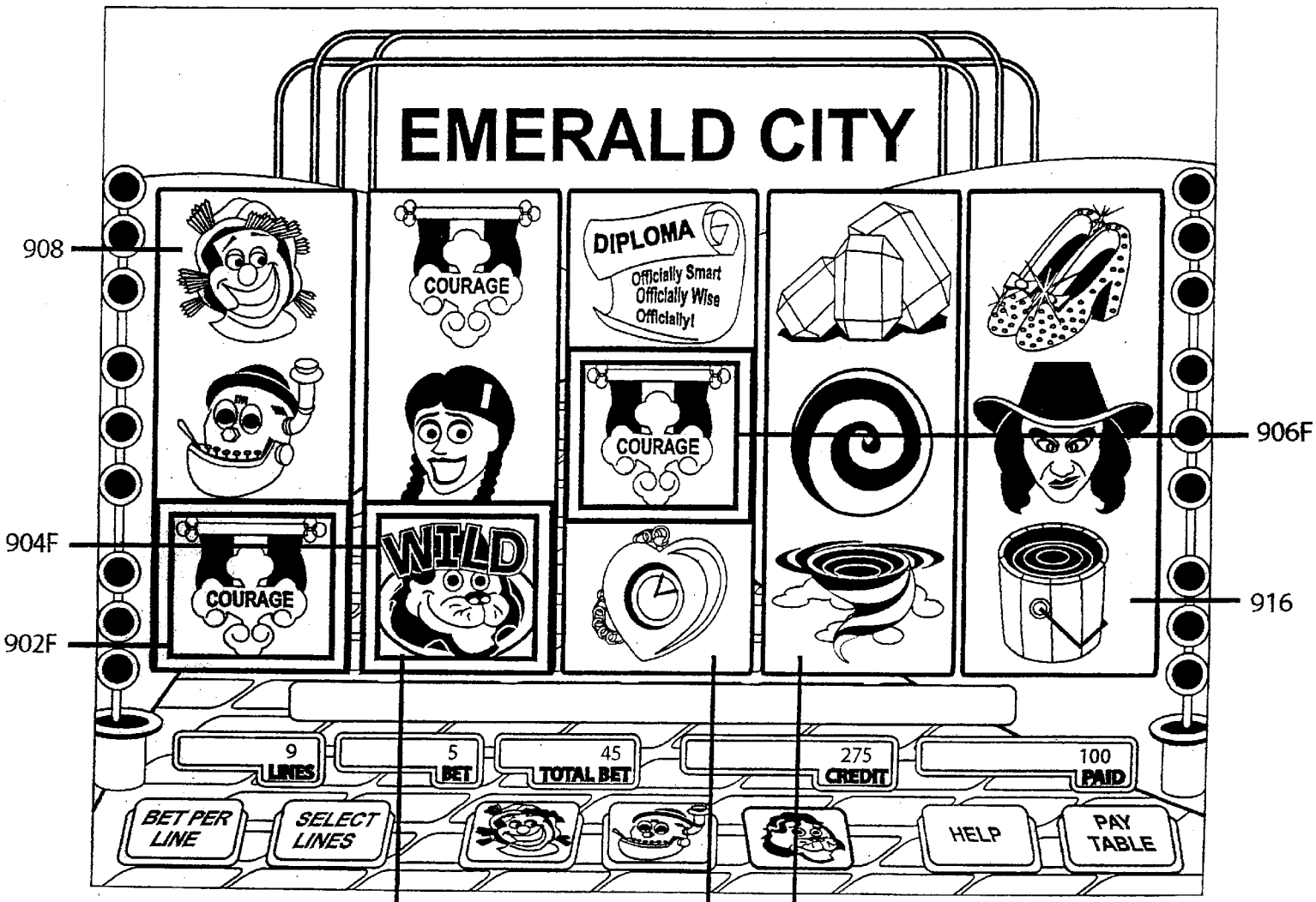

Wild Symbols—Use. FIGS. 9*d–f* show how the selected wild symbol is used to replace any or all other symbols to form winning symbol combinations:

FIG. 9*d* shows a line pay of three Diploma symbols 902*d*, 904*d*, and 906*d* and one Wild symbol 907*d* on slot reels 908, 910, 912, and 914.

FIG. 9*e* shows a line pay of two Heart symbols 902*e*, 906*e* and one Wild symbol 904*e* on slot reels 908, 910, and 912.

FIG. 9*f* shows a line pay of two Heart symbols 902*f*, 906*f* and one Wild symbol 904*f* on slot reels 908, 910, and 912. Alternatively, wild symbols may only replace limited subsets of the other symbols. Wild symbols, therefore, increase the possibility of a player achieving winning combinations and the pay table must reflect that the wild symbols are in use.

Wild Symbols—Value. In a preferred embodiment of the present invention, a wild symbol used to form a winning combination does not affect the value of that combination. Alternatively, a wild symbol used in a winning combination may increase or decrease the value of that combination, such as doubling the value.

Base Game Example. Sam Slotsky is standing in front of a nickel-denomination version of the preferred embodiment of the present invention. Sam sees a 5-reel slot game on the video display using a 5-column by 3-row symbol matrix.

Below the video display, the button panel holds nine buttons: Select Pay Lines, Bet Per Line, Bet Max, Pay Table, Help Cash Out, Spin 1 (Scarecrow), Spin 2 (Tin Man) and Spin 3 (Lion). In addition, there are also four meters on the video screen display below the game: Number of Pay Lines, Amount Bet Per Line, Total Bet and Paid.

Sam presses the Pay Table button to view the pays for winning combinations:

| | | | |
|---|---|---|---|
| 9-9-9-9-9 . . . 1000 | 9-9-9-9 . . . 150 | 9-9-9 . . . 50 | 9-9 . . . 3 |
| 8-8-8-8-8 . . . 1000 | 8-8-8-8 . . . 150 | 8-8-8 . . . 50 | 8-8 . . . 3 |
| 7-7-7-7-7 . . . 1000 | 7-7-7-7 . . . 150 | 7-7-7 . . . 50 | 7-7 . . . 3 |
| 6-6-6-6-6 . . . 500 | 6-6-6-6 . . . 75 | 6-6-6 . . . 25 | |
| 5-5-5-5-5 . . . 250 | 5-5-5-5 . . . 60 | 5-5-5 . . . 20 | |

-continued

| | | |
|---|---|---|
| 4-4-4-4-4 . . . 150 | 4-4-4-4 . . . 45 | 4-4-4 . . . 15 |
| 3-3-3-3-3 . . . 100 | 3-3-3-3 . . . 30 | 3-3-3 . . . 10 |
| 2-2-2-2-2 . . . 50 | 2-2-2-2 . . . 15 | 2-2-2 . . . 5 |
| 1-1-1-1-1 . . . 30 | 1-1-1-1 . . . 10 | 1-1-1 . . . 3 |

Sam deposits $20 into the bill receptor and the Credits meter counts up from 0 to 400 since the denomination for this game is five cents per credit. Sam then his chooses the wager for the game:

The game's Number of Pay Lines meter reads 1. Sam presses the Select Pay Lines button four times and the Number of Pay Lines meter counts up from 1 to 5. As Sam presses the Select Pay Lines button, the video display shows the locations of each selected pay line on the 5-column by 3-row matrix. For example, the first pay line starts in the middle row of the first column and proceeds in the straight line through the middle row of columns 2 through 5;

The game's Amount Bet Per Line meter reads 1. Sam presses the Bet Per Line button two times and the Amount Bet Per Line meter counts up from 1 to 3;

The Total Bet meter started at 1, but after Sam's adjustments it now reads 15; and The Paid meter reads 0.

After setting his wager, Sam selects a wild symbol by selecting one of the three spin buttons. The selected spin button is lit up and the unselected spin buttons are grayed. Sam selects Symbol 7 (Scarecrow). The Credits meter counts down from 400 to 385. The slot reels spin and then come to a stop. Using the numbers 1 to 9 to represent the symbol set, with number 10 as the repeating scatter symbol and number 7 selected as the wild symbol, the reels of the game display the following symbols:

5 1 6 8 5

4 7 4 4 4

3 6 5 9 7

Winning Symbol Combination in Bold

The game awards Sam a total of 510 credits for winning symbol combination of 4-7-4-4-4 on pay line 1 and 5-7-5 on pay line 4:

For the 4-7-4-4-4 combination, the 7 acts as a 4 to form 4-4-4-4-4. According to the game's pay table, the 4-4-4-4-4 combination pays 150 credits for each credit wagered upon the pay line; or 150 credits times three credits wagered by Sam on pay line 1 for a total of 450.

For the 5-7-5 combination, the 7 acts as a 5 to form 5-5-5. According to the game's pay table, the 5-5-5 combination pays 20 credits for each credit wagered upon the pay line; or 20 credits times three credits wagered by Sam on pay line 4 for a total of 60.

Thus, the Credits meter counts up from 385 to 895 and the game Paid meter reads 510.

Again, Sam may select a wild symbol by selecting one of the three spin buttons. Sam selects symbol 8 (tin man). The selected spin button is lit up and the unselected spin buttons are grayed. The Credits meter counts down from 895 to 880. The slot reels spin and then come to a stop. Using the numbers 1 to 9 to represent the symbol set, with number 10 as the repeating scatter symbol and number 8 selected as the wild symbol, the reels of the game display the following symbols:

| | | | | |
|---|---|---|---|---|
| **2** | **8** | **2** | 3 | 5 |
| 4 | 1 | 3 | 9 | 9 |
| 3 | 7 | 7 | 3 | 7 |

Winning Symbol Combination in Bold

The game awards Sam a total of 15 credits for winning symbol combination of 2-8-2 on pay line 2. In this combination, the 8 acts as a 2 to form 2-2-2. According to the game's pay table, the 2-2-2 combination pays 5 credits for each credit wagered upon the pay line; or 5 credits times three credits wagered by Sam on pay line 2 for a total of 15. The Credits meter counts up from 880 to 895 and the game Paid meter reads 15.

Note that Sam could have selected the 7 symbol again by pressing it or simply pressing the Spin button. If no symbol is selected before a spin, the game optionally uses the previously selected symbol or a default symbol. If Sam had selected symbol 7 as wild, he would have collected for the 3-7-7-3-7 combination on pay line 3 and the 3-7-3-3 combination on payline 7.

Content with his winnings, Sam presses the Cash Out button. The gaming device issues 895 nickels or any other form of currency, including cash, a standard EZ-PAY™ ticket, or standard electronic and/or credit card payment.

Bonus Features. During play of the base games, the player may receive any number of special pays for bonus features, such as Scatter pays.

Scatter Pays. FIGS. 9*b* and 9*c* show scatter pays that award the player a predetermined payout for the appearance of scatter symbols on the slot reels:

FIG. 9*b* shows a "line scatter pay" that issues awards for scatter symbols 902*b*, 904*b*, and 906*b* anywhere on a pay line; and/or FIG. 9*c* shows a "reel scatter pay" that issues awards for scatter symbols 902*c* and 904*c* anywhere on the slot reels 908–916.

The Scatter pays illustrated in FIGS. 9*b* or 9*c* issue a specific number of credits. The credits may be issued immediately or after the completion of a bonus feature (e.g., animation sequence or animated bonus game). The calculation of the-scatter pay award depends on the type of scatter pay:

For the line scatter pay in FIG. 9*b*, the number of credits wagered on the winning pay line are multiplied by the number of credits indicated by the pay table. For example, a player may wager two credits each on five pay lines, spin the reels, and collect twice the amount indicated on the pay table for a line pay or line scatter pay appearing on any of the five played pay lines. Alternative methods may be used to calculate the actual amount of the award.

For the reel scatter pay in FIG. 9*c*, the total number of credits wagered are multiplied by the number of credits indicated by the pay table. For example, a player may wager ten total credits, spin the reels, and collect ten times the amount indicated on the pay table for a reel scatter pay appearing on anywhere on the slot reels. Alternative methods may be used to calculate the actual amount of the award.

In a preferred embodiment of the present invention, there are two scatter pays: FIG. 9*b*—Select-A-Scatter Pay and FIG. 9*c*—Repeating Scatter Pay.

Select-A-Scatter Pay: FIG. 9*b* shows three Select-A-Scatter symbols 902*b*, 904*b*, and 906*b* on an active pay line. These scatter symbols trigger the optional Select-A-Scatter Pay bonus feature, as shown in FIGS. 10*a*–10*d*. The appearance of 3 or more non-selected wild symbols on a pay line, however, does not trigger the bonus feature in this embodiment, although in other embodiments the Select-A-Scatter Pay bonus feature may be triggered based on any predetermined criteria.

FIGS. 10*a*–10*d* show the Select-A-Scatter Pay second-screen bonus event in which the player selects objects from, for example, a 6 by 3 table 1002. Each object 1004–1038 in the table has a value 1012*b*, and/or an optional multiplier 1018*c* and/or terminator 1028*d*. The player selects an object 1004–1038—collecting credits 1012*b* and multipliers 1018*c*—until selecting a terminator 1028*d*.

Figure 10A:
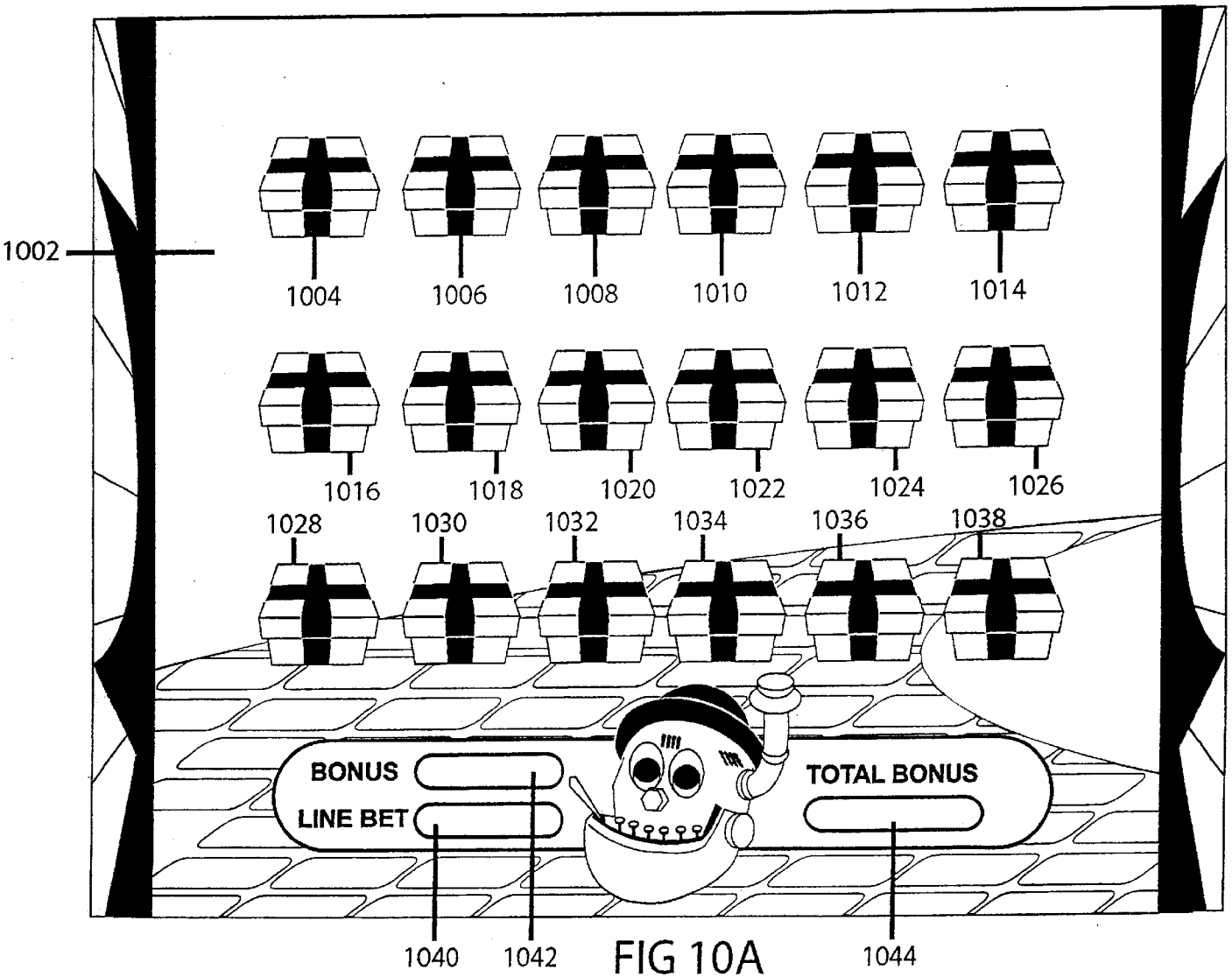
Figure 10B:
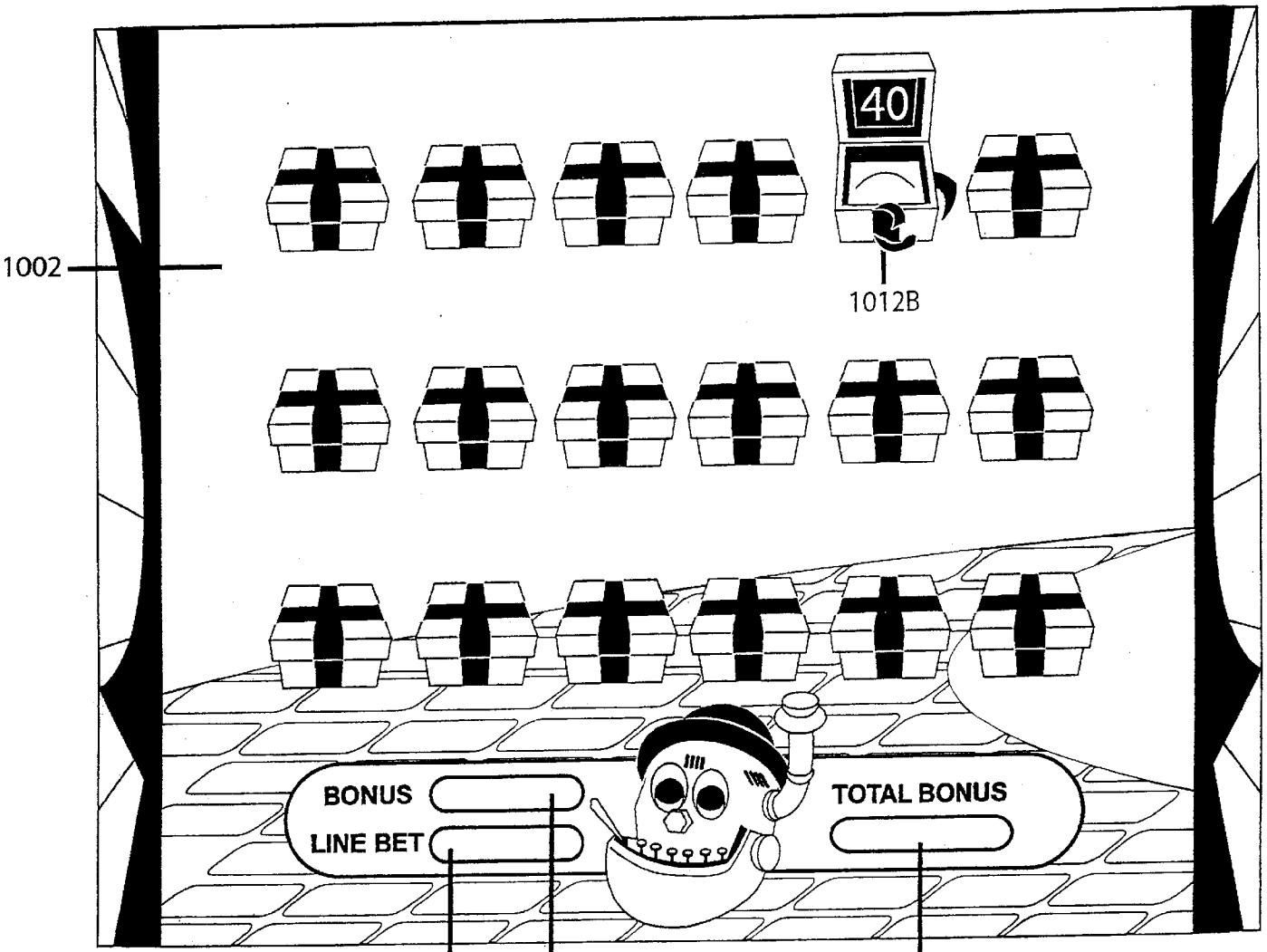
Figure 10C:
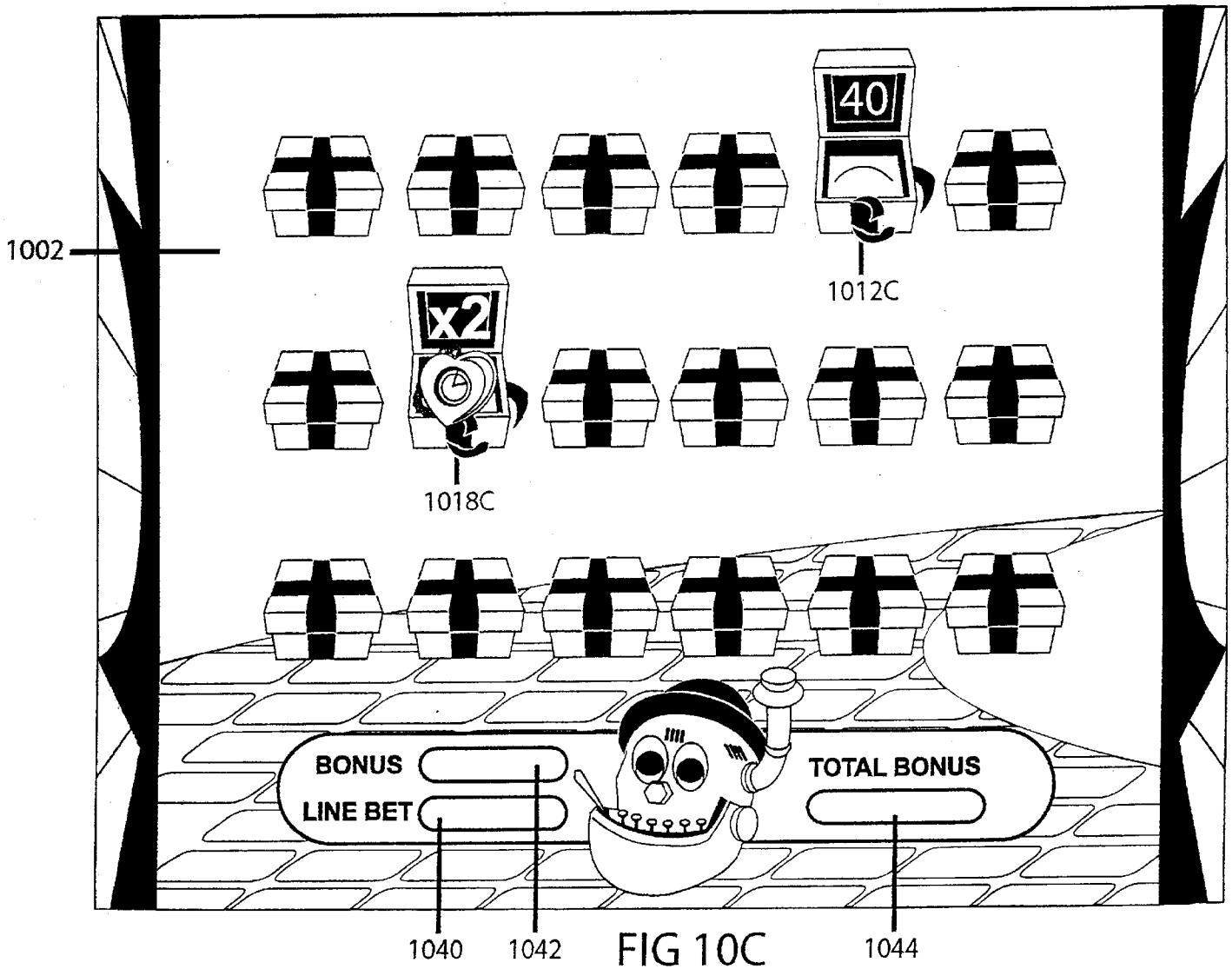
Figure 10D:
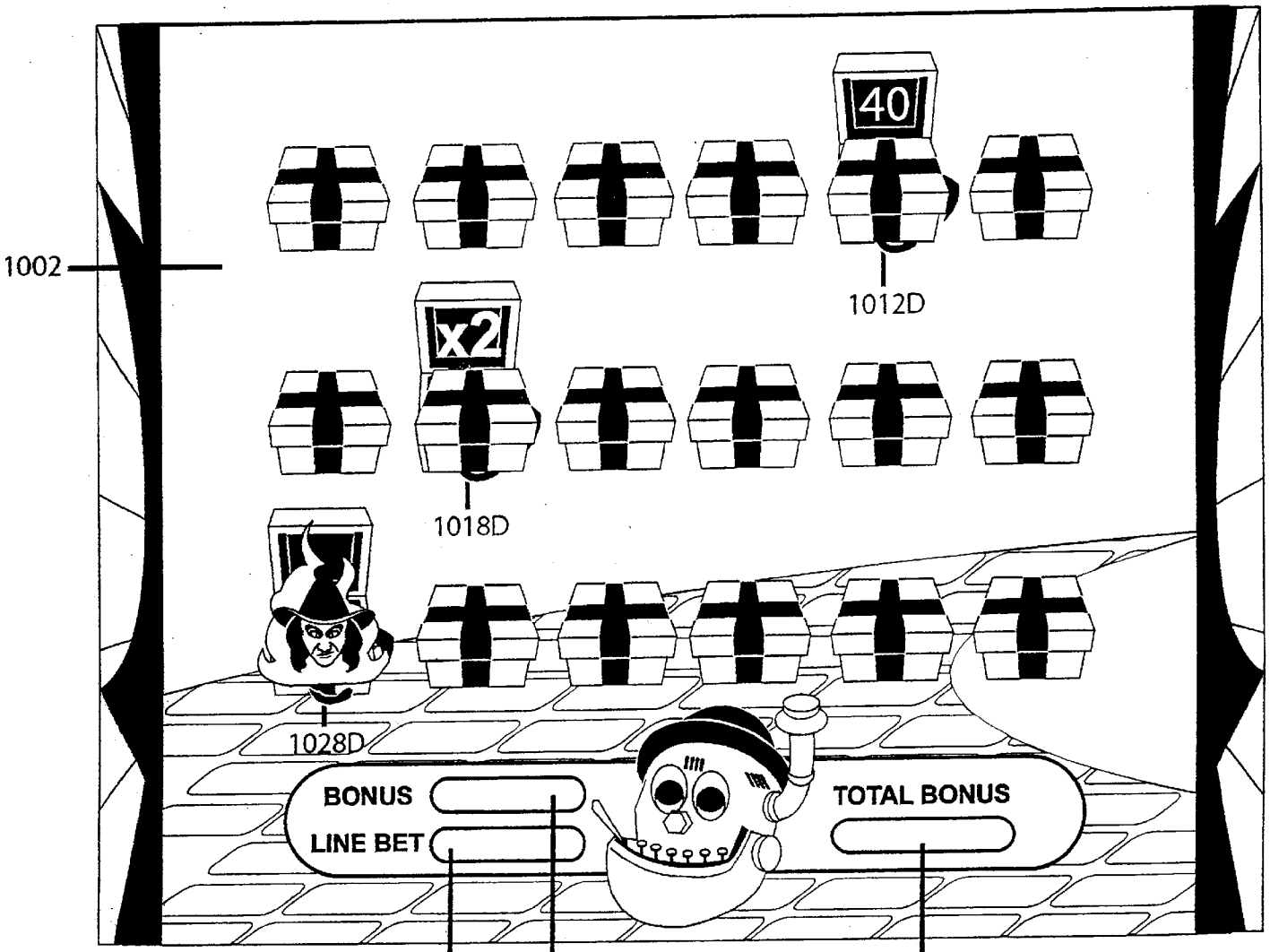

FIGS. 10*b*–10*d* show the credit value of the selected object in the bonus window 1040; the bet per line wager in line bet window 1042; and the accumulated number of credits in the total bonus window 1044. More specifically, FIGS. 10*b*–10*d* display the result of optionally revealing a credit, multiplier and terminator object, as follows:

In FIG. 10*b* the player reveals a credit object 1012*b*. For each credit object, the game displays the value of the object in the bonus window 1040, multiplies the value by the line bet shown in line bet window 1042, and adds the resulting amount to the cumulative total shown in total bonus window 1044.

In FIG. 10*c*, the player reveals the multiplier object 1018*c*. For each multiplier object, the value displayed in the total bonus window 1044 is multiplied by the value displayed on the multiplier object.

In FIG. 10*d*, the player reveals the terminator object 1028*d*. Upon selection of a terminator object, the game ends and the player receives the cumulative value displayed in the total bonus window 1044.

Repeating Scatter Pay. FIG. 9*c* shows two Repeating Scatter Pay symbols 902*c* and 904*c* on the slot reels 908 and 916. Any number of repeating scatter pay symbols may optionally be used. These scatter symbols trigger the optional Repeating Scatter Pay bonus feature, as shown in FIGS. 11*a*–11*f*.

FIGS. 11*a*–11*f* shows the Repeating Scatter Pay second-screen bonus event in which the player selects one of three objects 1102, 1104, and 1106. Each object 1102, 1104 and 1106 may contain credits 1114*b*, terminator 1120*d*–*f*, or an "extra life" 1116*c* (also displayed at 1118*c*–*e*) The player selects objects 1102, 1104, and 1106—collecting credits 1114*b* and extra lives 1116*c*—until selecting a terminator 1120*d*–*f*. If the player selects a terminator 1120*d*–*f* and has collected one or more extra lives 1116*c* (also displayed at 1118*c*–*e*), the player uses an extra life 1116*c* to continue play. If the player selects a terminator 1120*d*–*f* and does not have an extra life, the game ends.

Figure 11A:
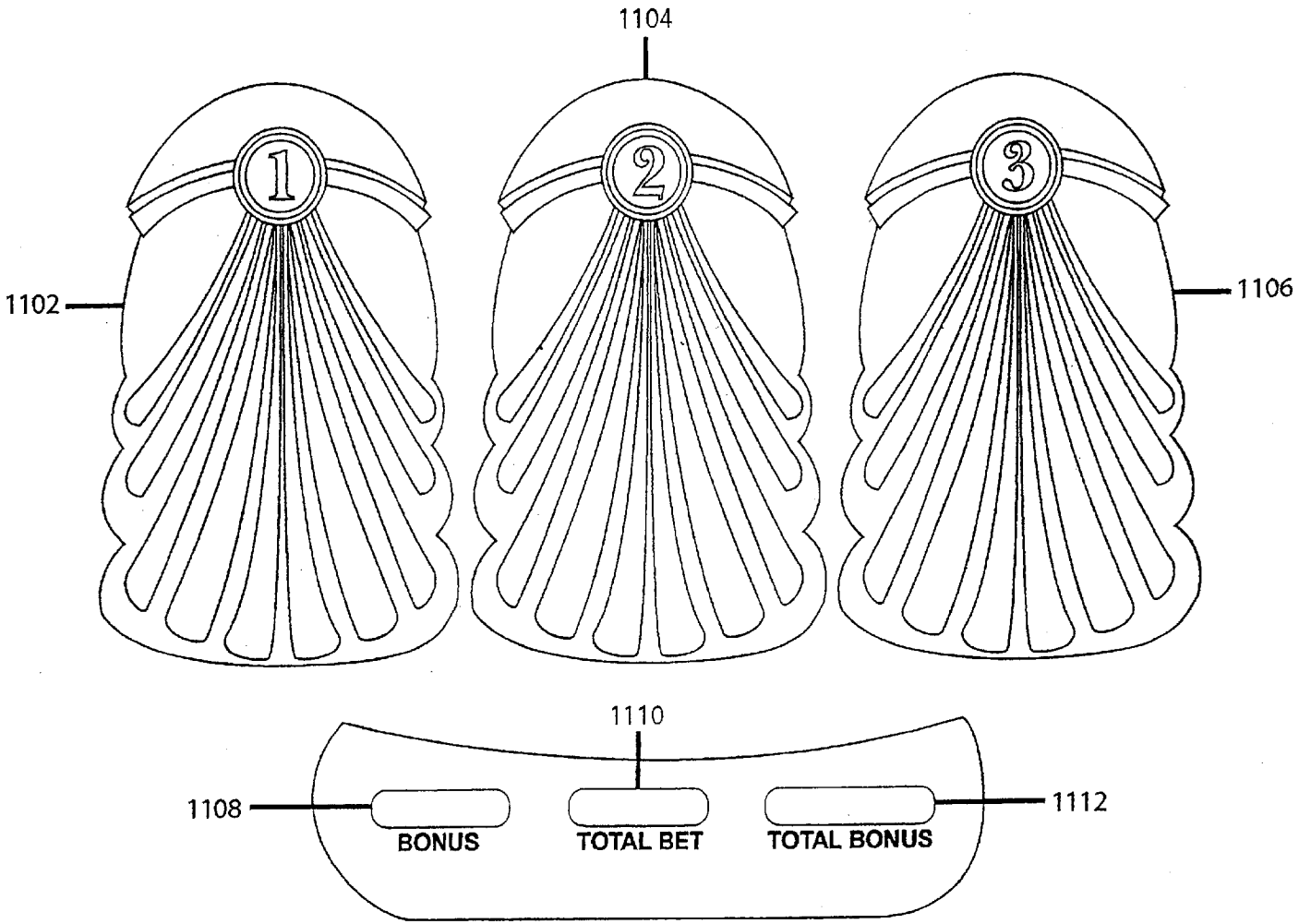
FIGS. 11*a*–*f* show an illustrative example of representative displays that may be encountered during a typical bonus game in accordance with the principles of the present invention.
Figure 11B:
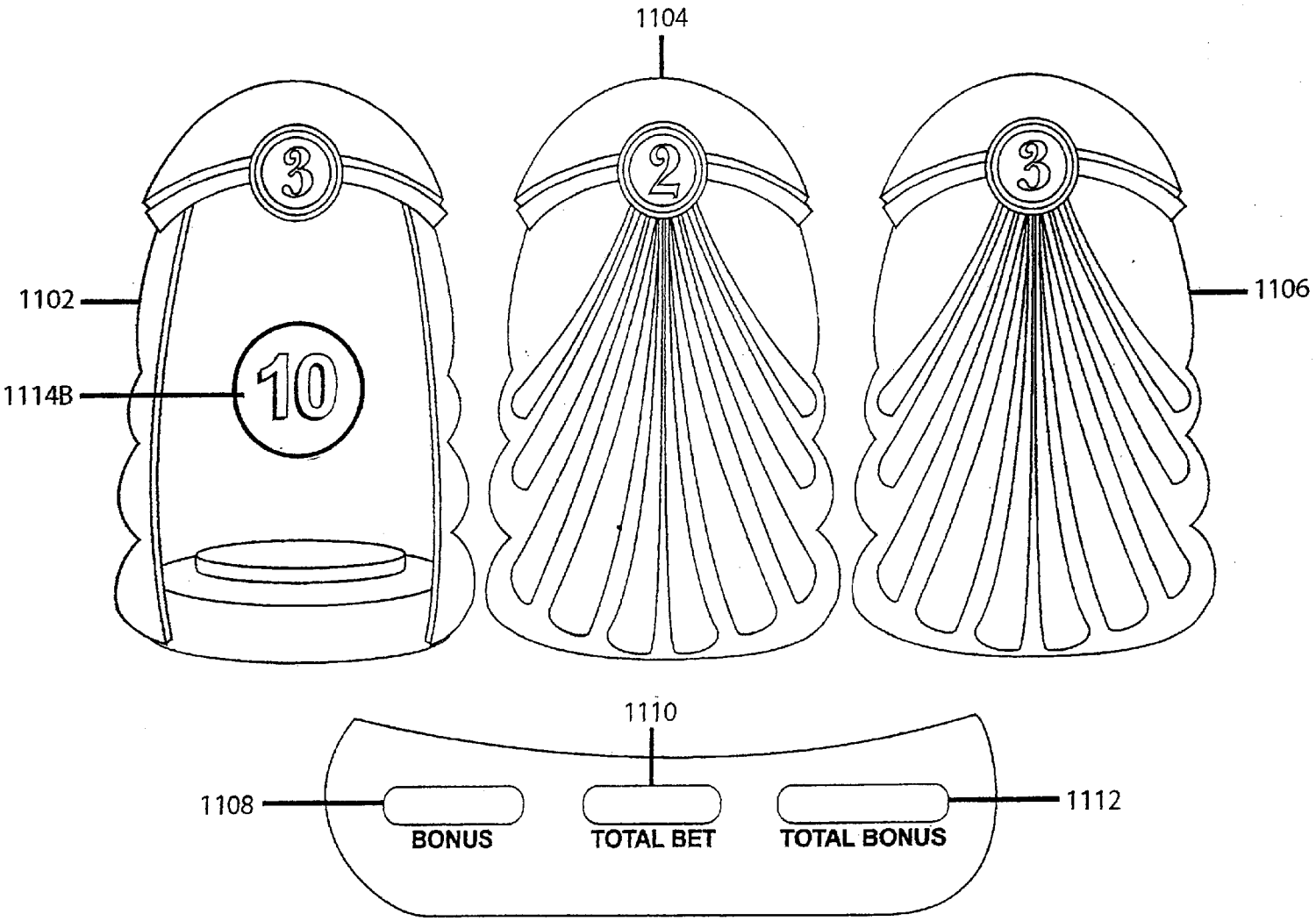

FIGS. 11*a*–11*f* show the credit value of selected object in the bonus window 1108; the total wager in total bet window 1110; and the accumulated number of credits in the total bonus window 1112. More specifically, FIGS. 11*b*–*f* display the result of revealing a credit, "extra life" and terminator object, as follows:

In FIG. 11*b* the player reveals a credit object 1114*b*. For each credit object, the game displays the value of the object in the bonus window 1108, multiplies the value by the total wager shown in total bet window 1110, and adds the resulting amount to the cumulative total shown in total bonus window 1112.

Figure 11C:
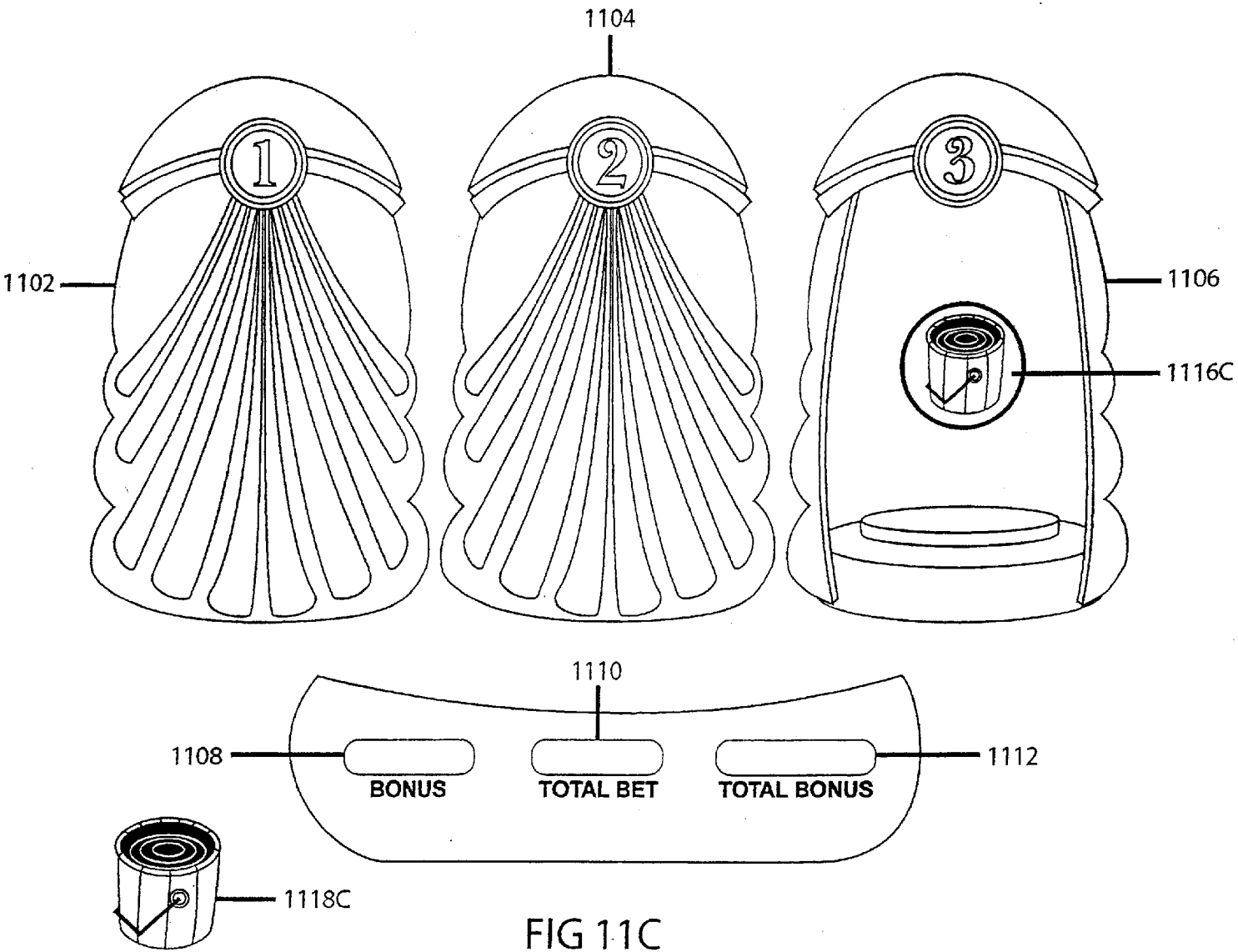

In FIG. 11*c*, the player reveals the "extra life" object 1116*c* (also displayed at 1118*c–e*). Each "extra life" object does not have a credit value and does not affect the accumulated number of credits.

Figure 11D:
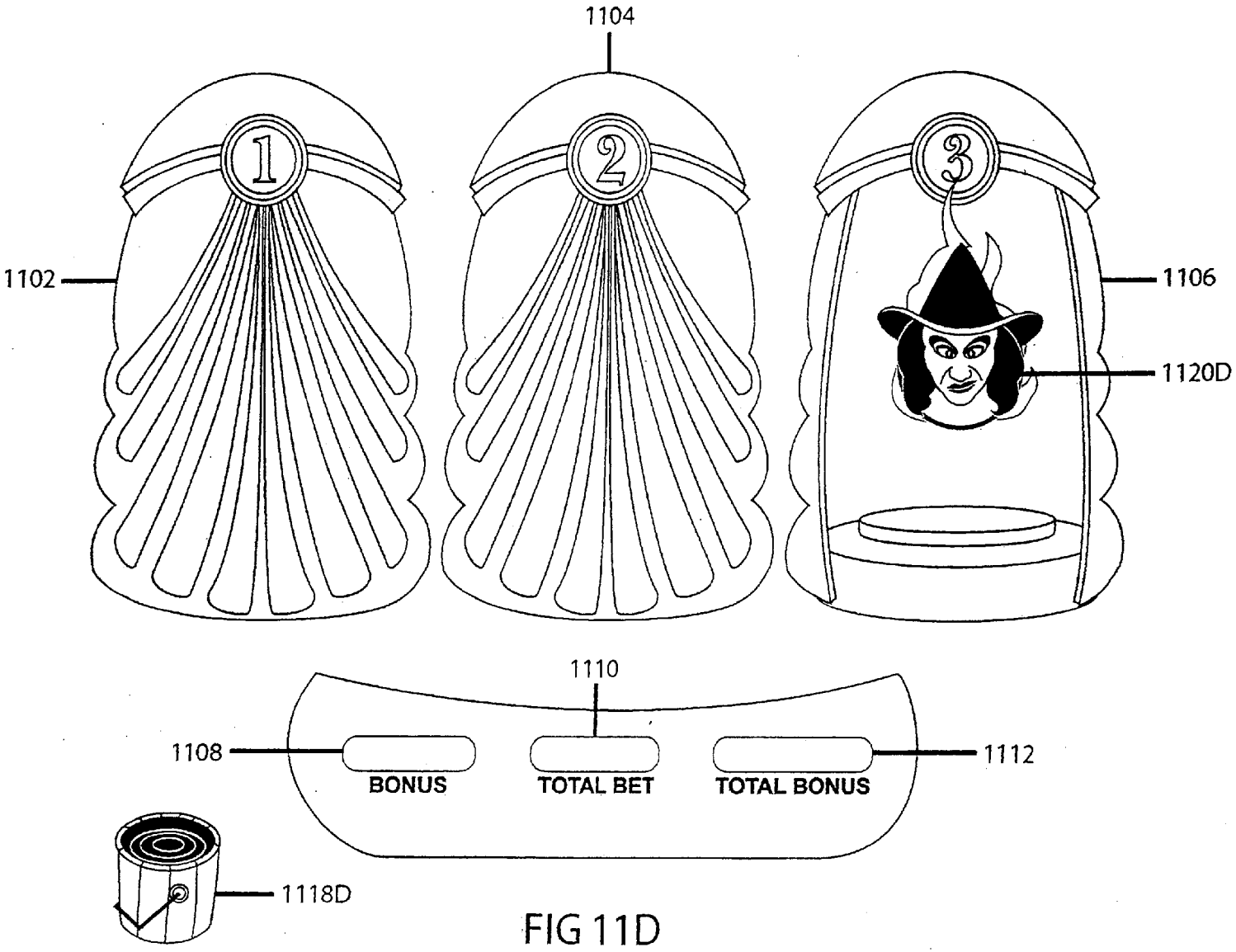
Figure 11E:
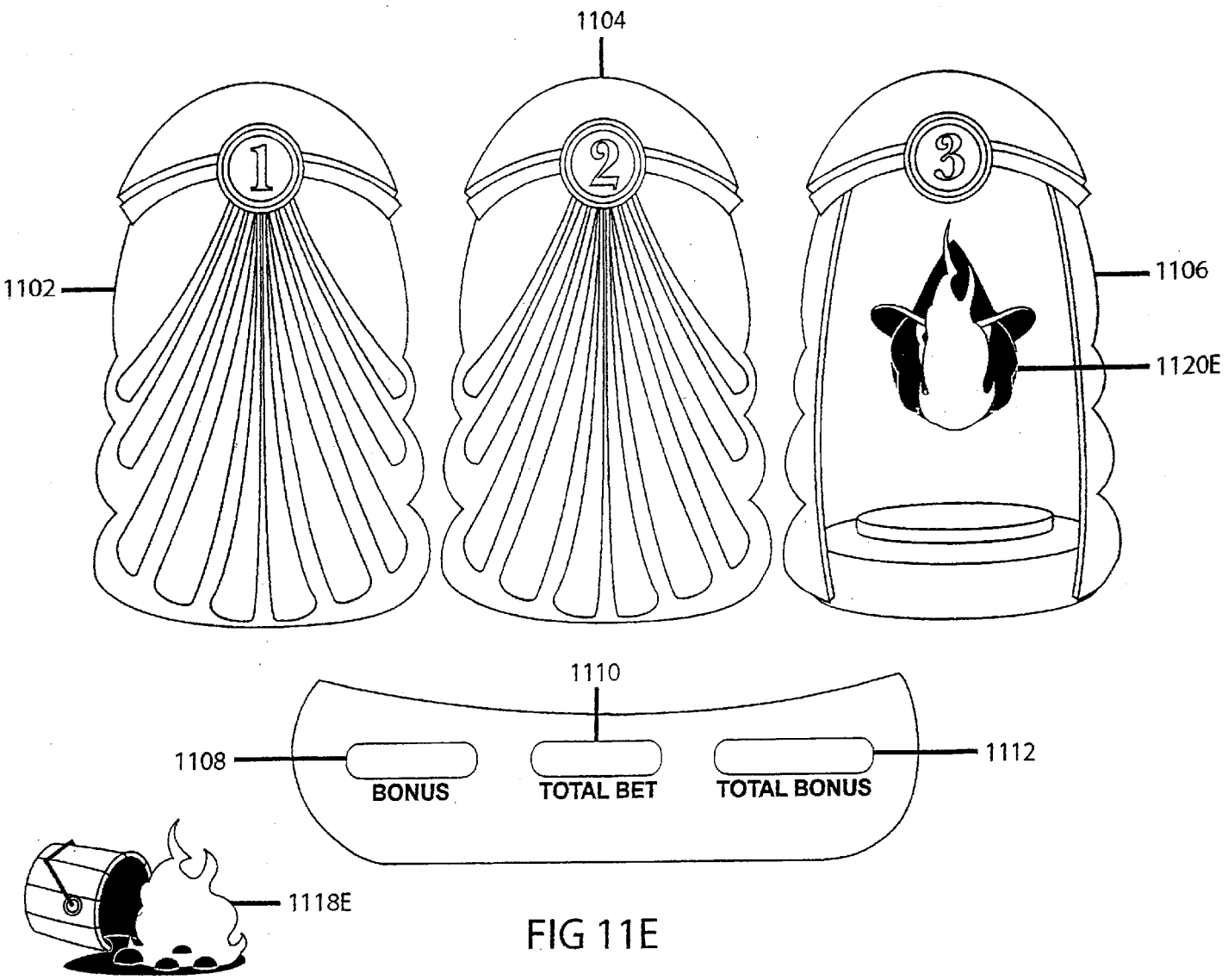

In FIG. 11*d*, the player has already collected an extra life 1118*d* on previous turn. On this turn, the player reveals the terminator object 1120*d*. FIG. 11*e* shows how the extra life 1118*e* is used to avoid the effect of the terminator object 1120*e* and continue the bonus game.

Each extra life may be used to avoid the effects of one terminator object. The use of an extra life does not have a credit value and does not affect the accumulated number of credits.

Figure 11F:
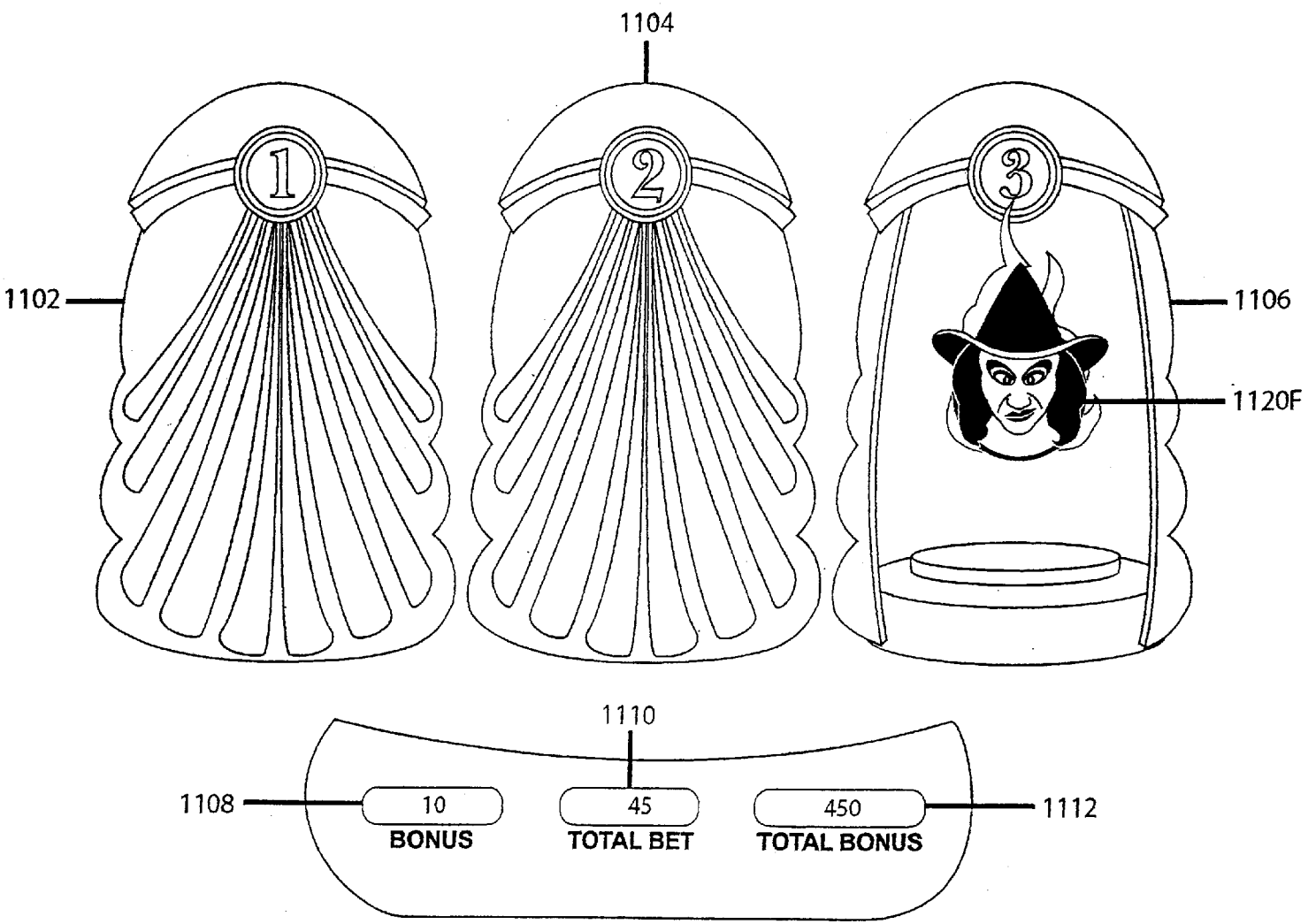

In FIG. 11*f*, the player has not collected an extra life (or has already used all of the extra lives). On this turn, the player reveals the terminator object 1120*f*. Upon selection of a terminator object, the game ends and the player receives the cumulative value displayed in the total bonus window 1112.

Bonus Feature Example. Sam Slotsky returns to the same nickel-denomination version of the preferred embodiment of the present invention, as described above in the Base Game Example section. Sam deposits $20 into the bill acceptor and the Credits meter counts up from 0 to 400. Sam then presses the Help button to view the rules of the game and the pay table.

After reading the rules and pays, Sam returns to the base game screen. Using the control buttons, Sam adjusts his wagers for the game; he sets the Number of Pay Lines at 9 and the Amount Bet Per Line at 2.

After setting his wagers, Sam selects a wild symbol by selecting one of the three spin buttons. Sam selects symbol 8 (tin man). The selected spin button is lit up and the unselected spin buttons are grayed. The Credits meter counts down from 400 to 382. The slot reels spin and then come to a stop. Using the numbers 1 to 9 to represent the symbol set, with number 10 as the repeating scatter symbol and number 8 selected as the wild symbol, the reels of the game display the following symbols:

*8* *8* 2 *8* 5

4 1 3 9 9

3 7 7 3 7

Winning Symbol Combination in Bold

Select-A-Scatter/Wild Symbols in Italic Bold

The game awards Sam a total of 100 credits for winning symbol combination of 8-8-2-8 on pay line 2. In this combination, the 8 acts as a 2 to form 2-2-2-2. According to the game's pay table, the 2-2-2-2 combination pays 50 credits for each credit wagered upon the pay line; or 50 credits times two credits wagered by Sam on pay line 2 for a total of 100. The Credits meter counts up from 382 to 482 and the game Paid meter reads 100.

In addition, the game displays a second screen that shows eighteen box symbols in a six-by-three grid. The game instructs the player to select a symbol. Upon selection, the game displays a number of bonus credits, a multiplier, or an end of game indicator. In one embodiment of the invention, the player continues to select box symbols that reveal possible awards until the player receives an end of game symbol. Alternatively, a player may only be permitted to select a predetermined number of box symbols even if the player does not receive an end of game symbol.

For the purposes of this example, the player selected seven of the eighteen box symbols and on the seventh selection received an end of game symbol, as follows: 10, 20, 200, 4, 2X, 100 and end of game. With the first four picks, the player accumulated 234 credits. With the fifth pick, the player multiplied the accumulated credits by 2, or an additional 234 credits for a total of 468 credits. With the sixth pick, the player accumulates an additional 100 credits for a total of 568 credits. And, with the seventh pick, the player ends the game and collects 568 credits. The Credits meter counts up from 482 to 1050 and the game Paid meter reads 568.

Note that the 8-8-2-8 combination awarded Sam 100 credits for the line pay and 568 credits for the bonus game. Thus, Sam collected 668 total credits for that spin. Alternatively, only the Bonus Feature game may be utilized resulting in 568 credits for Sam.

Again, Sam selects a wild symbol by selecting one of the three spin buttons. Sam selects symbol 7 (Scarecrow). The selected spin button is lit up and the unselected spin buttons are grayed. The Credits meter counts down from 1050 to 1032. The slot reels spin and then come to a stop. Using the numbers 1 to 9 to represent the symbol set, with number 10 as the repeating scatter symbol and number 7 selected as the wild symbol, the reels of the game display the following symbols:

3 8 2 8 5

*10* 1 3 9 9

3 9 5 3 *10*

Repeating Scatter Pay Symbols in Italic Bold

The player has won the ability to play the repeating scatter pays bonus game. The game displays a second screen that shows three curtained booths side-by-side. The game instructs the player to select a curtained booth. Upon selection, the curtain reveals either a number of bonus credits, an "extra life", or an end of game indicator.

For the purposes of this example, the player selects symbols, as follows: 36, 180, extra life, 18, end of game, 20 360, 72, 18 and end of game. With the first two picks, the player accumulated 216 credits. With the third pick, the player collected an extra life. In one embodiment of the invention, the player continues to select curtains until the termination symbol is revealed. With each turn, the curtain open to reveal an object, and then close. The player may continue to select curtains for as long as the game permits. With the fourth pick, the player accumulates an additional 18 credits for a total of 234 credits. With the fifth pick, the player revealed the end of the game indicator but used the extra life to continue play. With the sixth, seventh and eight picks, the player accumulates an additional 450 credits for a total of 684 credits. And, with the ninth pick, the player ends the game and collects 684 credits. The Credits meter counts up from 1,032 to 1,716 and the game Paid meter reads 684.

Content with his winnings, Sam presses the Cash Out button. The gaming device issues 1,716 nickels or any other form of currency, including cash, an EZ-PAY™ ticket, or electronic payment.

Figure 12:
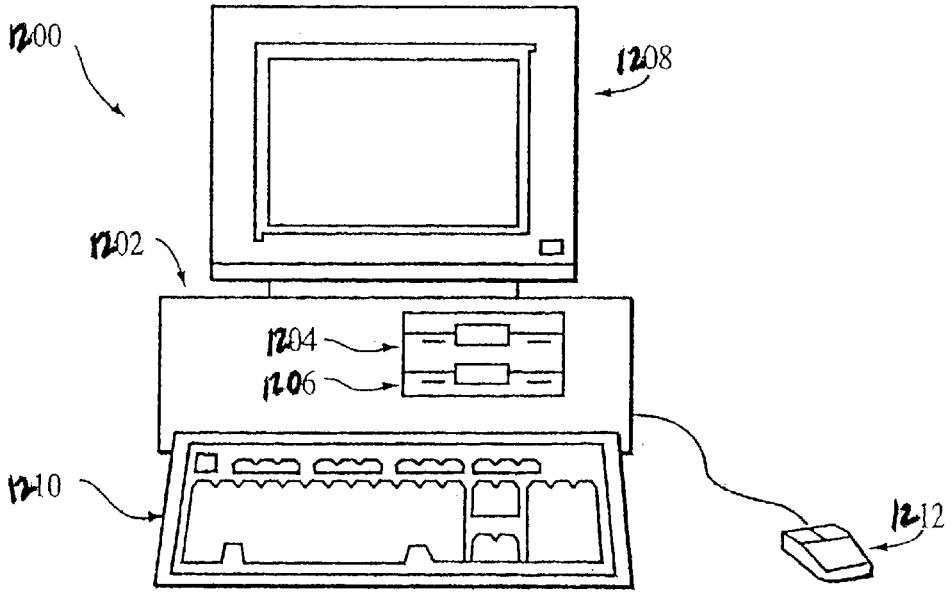
FIG. 12 illustrates one example of a central processing unit for implementing a computer process in accordance with a computer implemented stand-alone embodiment of the present invention.

The techniques of the present invention may be implemented on standard stand-alone casino gaming devices, as well as in a computing unit such as that depicted in FIG. 12. In this regard, FIG. 12 is an illustration of a main central processing unit which is also capable of implementing some or all of the computer processing in accordance with a computer implemented embodiment of the present invention. The procedures described herein are presented in terms of program procedures executed on, for example, a computer or network of computers.

Viewed externally in FIG. 12, a computer system designated by reference numeral 1200 has a computer 1202 having disk drives 1204 and 1206. Disk drive indications 1204 and 1206 are merely symbolic of a number of disk drives which might be accommodated by the computer system. Typically, these would include a floppy disk drive 1204, a hard disk drive (not shown externally) and a CD ROM indicated by slot 1206. The number and type of drives vary, typically with different computer configurations. Disk drives 1204 and 1206 are in fact optional, and for space considerations, are easily omitted from the computer system used in conjunction with the production process/apparatus described herein.

The computer system also has an optional display 1208 upon which information, such as the screens illustrated in FIGS. 6–8, may be displayed. In some situations, a keyboard 1210 and a mouse 1212 are provided as input devices through which a player's actions may be inputted, thus allowing input to interface with the central processing unit 1202. Then again, for enhanced portability, the keyboard 1210 is either a limited function keyboard or omitted in its entirety. In addition, mouse 1212 optionally is a touch pad control device, or a track ball device, or even omitted in its entirety as well, and similarly may be used to input a player's selections. In addition, the computer system may also optionally include at least one infrared transmitter and/or infrared received for either transmitting and/or receiving infrared signals. Instead of utilizing an infrared transmitter or infrared receiver, the computer system optionally uses a low power radio transmitter and/or a low power radio receiver. The low power radio transmitter transmits the signal for reception by components of the production process, and receives signals from the components via the low power radio receiver. The low power radio transmitter and/or receiver are standard devices in industry.

Although computer system 1200 is illustrated having a single processor, a single hard disk drive and a single local memory, the system 1200 is optionally suitably equipped with any multitude or combination of processors or storage devices. Computer system 1200 is, in point of fact, able to be replaced by, or combined with, any suitable processing system operative in accordance with the principles of the present invention, including sophisticated calculators, and hand-held, laptop/notebook, mini, mainframe and super computers, as well as processing system network combinations of the same.

Figure 13:
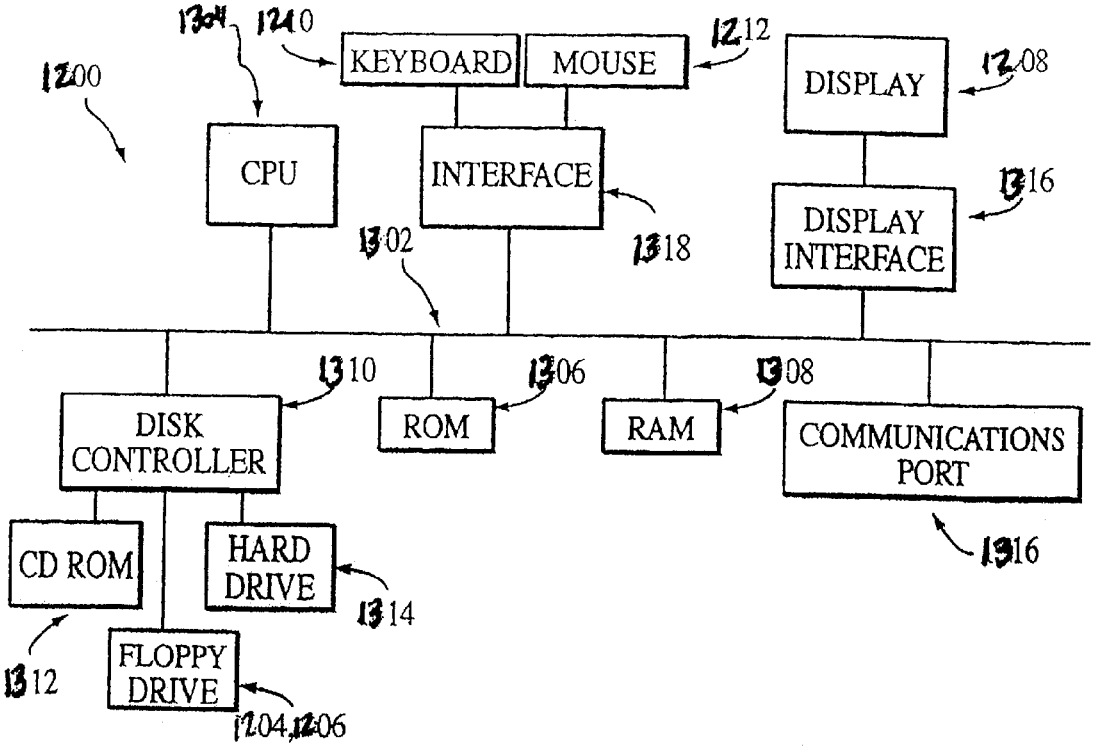
FIG. 13 illustrates one example of a block diagram of internal hardware of the central processing unit of FIG. 12.

FIG. 13 illustrates a block diagram of the internal hardware of the computer system 1200 of FIG. 12. A bus 1302 serves as the main information highway interconnecting the other components of the computer system 1200. CPU 1304 is the central processing unit of the system, performing calculations and logic operations required to execute a program. Read only memory (ROM) 1306 and random access memory (RAM) 1308 constitute the main memory of the computer. Disk controller 1310 interfaces one or more disk drives to the system bus 1302. These disk drives are, for example, floppy disk drives such as 1204 or 1206, or CD ROM or DVD (digital video disks) drive such as 1312, or internal or external hard drives 1314. As indicated previously, these various disk drives and disk controllers are optional devices.

A display interface 1318 interfaces display 1208 and permits information from the bus 1302 to be displayed on the display 1208. Again as indicated, display 1208 is also an optional accessory. For example, display 1208 could be substituted or omitted. Communications with external devices, for example, the other components of the system described herein, occur utilizing communication port 1316. For example, optical fibers and/or electrical cables and/or conductors and/or optical communication (e.g., infrared, and the like) and/or wireless communication (e.g., radio frequency (RF), and the like) can be used as the transport medium between the external devices and communication port 1316. Peripheral interface 1318 interfaces the keyboard 1210 and the mouse 1212, permitting input data to be transmitted to the bus 1302.

Conventional processing system architecture is more fully discussed in *Computer Organization and Architecture*, by William Stallings, MacMillan Publishing Co. (3rd ed. 1993); conventional processing system network design is more fully discussed in *Data Network Design*, by Darren L. Spohn, McGraw-Hill, Inc. (1993), and conventional data communications are more fully discussed in *Data Communications Principles*, by R. D. Gitlin, J. F. Hayes and S. B. Weinstain, Plenum Press (1992) and in *The Irwin Handbook of Telecommunications*, by James Harry Green, Irwin Professional Publishing (2nd ed. 1992). Each of the foregoing publications is incorporated herein by reference. Alternatively, the hardware configuration is, for example, arranged according to the multiple instruction multiple data (MIMD) multiprocessor format for additional computing efficiency. The details of this form of computer architecture are disclosed in greater detail in, for example, U.S. Pat. No. 5,163,131; Boxer, A., Where Buses Cannot Go, IEEE Spectrum, February 1995, pp. 41–45; and Barroso, L. A. et al., RPM: A Rapid Prototyping Engine for Multiprocessor Systems, IEEE Computer February 1995, pp. 26–34, all of which are incorporated herein by reference.

In alternate preferred embodiments, the above-identified processor, and, in particular, CPU 1304, may be replaced by or combined with any other suitable processing circuits, including programmable logic devices, such as PALs (programmable array logic) and PLAs (programmable logic arrays). DSPs (digital signal processors), FPGAs (field programmable gate arrays), ASICs (application specific integrated circuits), VLSIs (very large scale integrated circuits) or the like.

Figure 14:
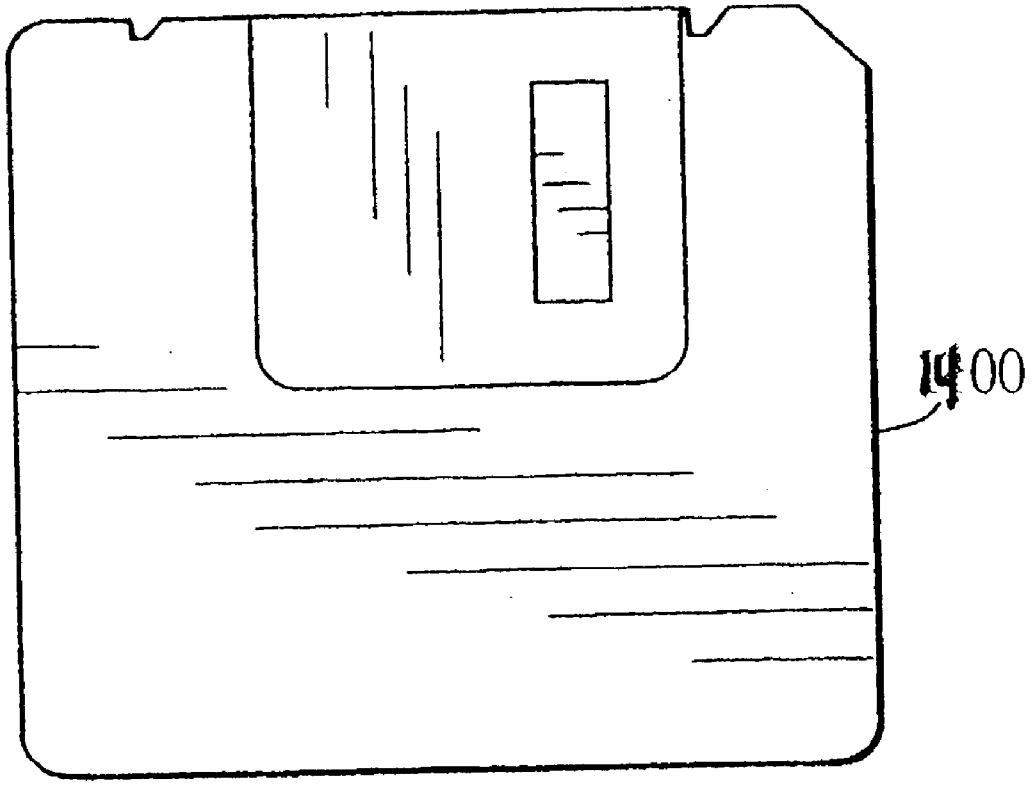
FIG. 14 illustrates one example of a memory medium which may be used for storing a computer implemented process of the present invention.

FIG. 14 is an illustration of an exemplary memory medium 1400 which can be used with disk drives illustrated in FIGS. 12 and 13. Typically, memory media such as floppy disks, or a CD ROM, or a digital video disk will contain, for example, a multi-byte locale for a single byte language and the program information for controlling the computer to enable the computer to perform the functions described herein. Alternatively, ROM 1306 and/or RAM 1308 illustrated in FIGS. 12 and 13 can also be used to store the program information that is used to instruct the central processing unit 1204 to perform the operations associated with the production process.

Figure 15:
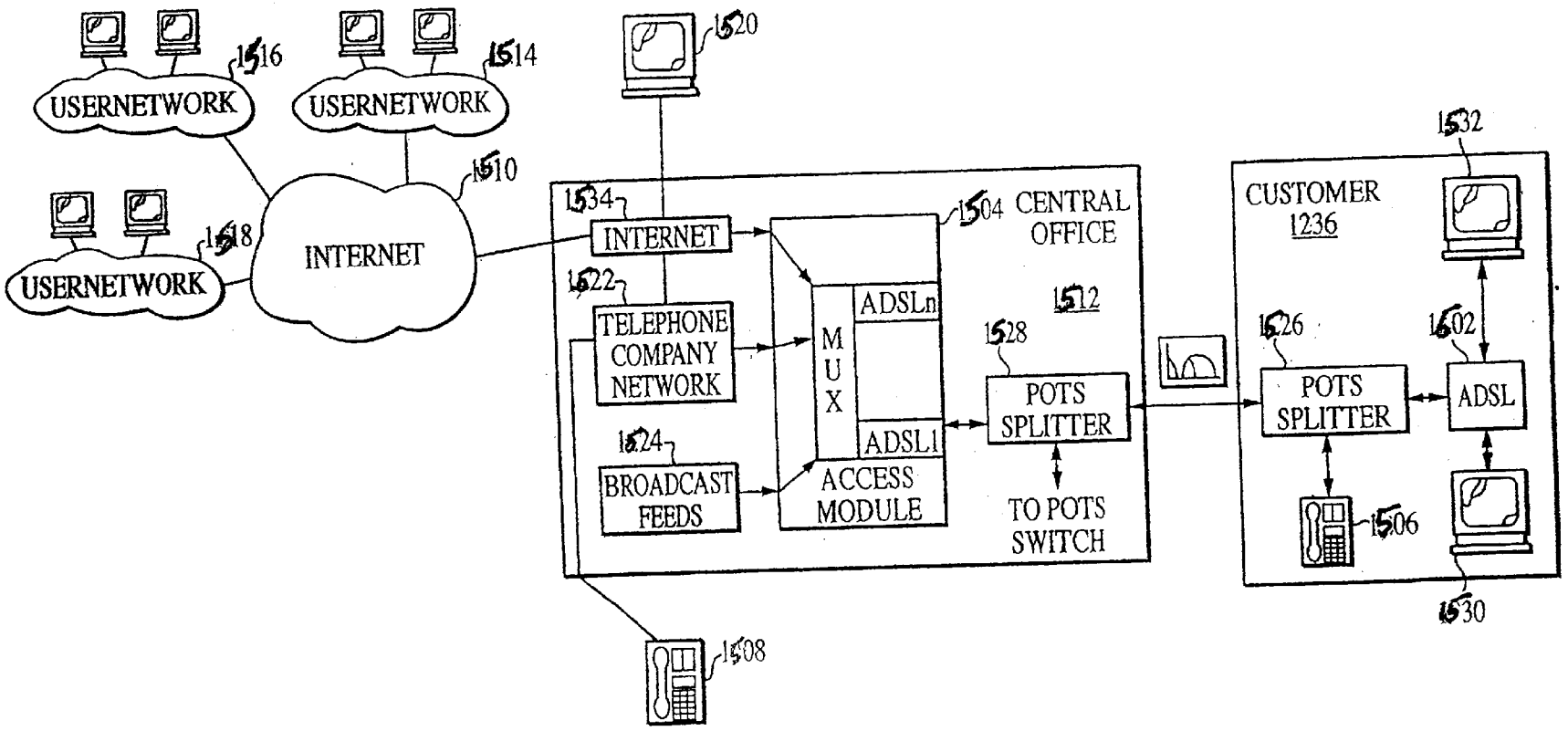
FIG. 15 illustrates an example of a combined Internet, POTS, and ADSL architecture which may be used with the present invention.

FIG. 15 is an illustration of the architecture of the combined Internet, POTS (plain, old, telephone service), and ADSL (asymmetric, digital, subscriber line) for use in accordance with the principles of the present invention.

Furthermore, it is to be understood that the use of the Internet, ADSL, and POTS are for exemplary reasons only and that any suitable communications network may be substituted without departing from the principles of the present invention. This particular example is briefly discussed below.

In FIG. 15, to preserve POTS and to prevent a fault in the ADSL equipment 1502, 1504 from compromising analog voice traffic 1506, 1508 the voice part of the spectrum (the lowest 4 kHz) is separated from the rest by a passive filter, called a POTS splitter 1526, 1528. The rest of the available bandwidth, from about 10 kHz to 1 MHz, carries data at rates up to 6 bits per second for every hertz of bandwidth from data equipment 1530, 1532, and 1520. The ADSL equipment 1204 then has access to a number of destinations including significantly the Internet 1510, and other destinations 1522, 1524, 1534.

To exploit the higher frequencies, ADSL makes use of advanced modulation techniques, of which the best known is the discrete multitone (DMT) technology. As its name implies, ADSL transmits data asymmetrically (i.e., at different rates upstream toward the central office 1512 and downstream toward the subscriber 1536).

Cable television providers are providing analogous Internet service to PC players over their TV cable systems by means of special cable modems. Such modems are capable of transmitting up to 30 Mb/s over hybrid fiber/coax system, which use fiber to bring signals to a neighborhood and coax to distribute it to individual subscribers.

Cable modems come in many forms. Most create a downstream data stream out of one of the 6-MHz TV channels that occupy spectrum above 50 MHz (and more likely 550 MHz) and carve an upstream channel out of the 5–50-MHz band, which is currently unused. Using 64-state quadrature amplitude modulation (64 QAM), a downstream channel can realistically transmit about 30 Mb/s (the oft-quoted lower speed of 10 Mb/s refers to PC rates associated with Ethernet connections). Upstream rates differ considerably from vendor to vendor, but good hybrid fiber/coax systems can deliver upstream speeds of a few megabits per second. Thus, like ADSL, cable modems transmit much more information downstream than upstream. Then Internet architecture 1510 and ADSL architecture 1502, 1504 may also be combined with, for example, player networks 1214, 1216, and 1218.

In accordance with the principles of the present invention, in one example, a main game server implementing the process of the invention may be located on one computing node or terminal (e.g., on player network 1514, or system 1520). Then, various players may interface with the main game server via, for instance, the ADSL equipment discussed above, and play the game from remotely located PCs. In this manner, a game owner may be able to attract players located at other parts of the country or planet.

Furthermore, the game according to the present invention may also be implemented manually. For instance, it is possible to play the game of the present invention as a standard slot machine or a mechanical slot machine having an expanded display area are previously discussed herein.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. While the foregoing invention has been described in detail by way of illustration and example of preferred embodiments, numerous modifications, substitutions, and alterations are possible without departing from the scope of the invention defined in the following claims.

Having thus described our invention, what we claim as new and desire to secure by Letters Patent is as follows:

1. A method of playing a game using a symbol matrix formed by at least one array, and optionally a plurality of rows intersecting with a plurality of columns, with the plurality of rows and columns optionally defining a plurality of pay lines, and including a plurality of symbols, comprising:

a) submitting, by a player, a wager to play the game;

b) selecting by the player at least one symbol capable of representing and replacing at least another of the plurality of symbols that may appear in the symbol matrix to maximize a reward for the player playing the game;

c) rearranging the plurality of symbols in accordance with at least one of predetermined criteria and random criteria;

d) displaying the rearranged symbols; and e) awarding the player based on at least one of the following winning arrangements of the rearranged symbols wherein:

1) when a first at least two predetermined symbols appear contiguously or partially contiguously on at least one of the plurality of pay lines;

2) when a second at least two predetermined symbols appear anywhere in the symbol matrix;

3) when a third at least one of: at least two predetermined symbols and the at least one selected symbol appear contiguously or partially contiguously on at least one of the plurality of pay lines; and 4) when a fourth at least one of: at least two predetermined symbols and the at least one selected symbol appear anywhere in the symbol matrix.

2. A method of claim 1, wherein said selecting step (b) further comprises the step of selecting by the player the at least one symbol from the entire set of the plurality of symbols that may appear in the symbol matrix.

3. A method of claim 1, wherein said selecting steb (b) further comprises the step of selecting by the player the at least one symbol from a subset of the plurality of symbols that may appear in the symbol matrix.

4. A method of claim 1, wherein said selecting step (b) further comprises the step of selecting by the player the at least one symbol by at least one of: touching areas of the display screen associated with each of the plurality of symbols, and by using at least one mechanical or electromechanical button associated with each of the plurality of symbols.

5. A method of claim 1, wherein said selecting step (b) further comprises selecting by the play the at least one symbol, and wherein the at least one symbol selected remains selected for subsequent plays of the game, unless the player selects a different symbol.

6. A method of claim 1, wherein selecting step (b) further comprises selecting by the player the at least one symbol before every N plays of the game, wherein N is one of: any fixed integer greater than zero, and a variable integer greater than zero.

7. A method of claim 1, wherein the at least one symbol selected by the player includes one of: a same probability of appearing in the symbol matrix, and a different probability of appearing in the symbol matrix.

8. A method of claim 1, wherein the at least one of symbol selected by the player replaces one of: any other symbol of the plurality of symbols, a predetermined sub-set of the plurality of symbols, first symbols that appear contiguously on at least one of pay lines, second symbols that appear partially contiguously on at least one of the pay lines, and third symbols that appear anywhere in the symbol matrix.

9. A method of claim 1, wherein the at least one symbol selected by the player at least one of: enhances any first award issued for a first combination of the plurality of symbols incorporating the at least one symbol selected by the player, changes any second award issued for a second combination of the plurality of symbols incorporating the at least one symbol selected by the player, and does not affect any third award issued for a third combination of the plurality of symbols incorporating the at least one symbol selected by the player.

10. A method of claim 1 wherein an appearance of at least three of the plurality of symbols selected by the player anywhere on at least one of the pay lines issues an award.

11. A method of claim 1, further comprising the step of determining a value of the award comprising the steps of:

1) displaying a matrix of awards of X-columns by Y-rows in accordance with first predetermined criteria;
2) assigning at least one of three values to each of the awards in the matrix, in accordance with second predetermined criteria, and the value of the awards hidden from the player, comprising at least one of:
   2*a*) a number of credits;
   2*b*) a multiplier of credits; and
   2*c*) an end-of-game indicator;
3) randomly arranging the awards;
4) selecting by the player at least one award from the matrix;
5) revealing the value of the award selected by the player;
6) removing the selected award from the matrix;
7) accumulating the value of all awards awarded to the player;
8) issuing the accumulated value of the awards to the player at the end of the game.

12. A method of claim 11, wherein a number of credits awarded falls within a range of positive integer values determined by an amount of credits wagered on at least one of a pay line and a total amount of credits wagered on the game.

13. A method of claim 11, wherein the multiplier is one of: a fixed, positive, integer value; and within a range of positive integers values, as determined by the amount of credits wagered on a pay line and/or the total amount of credits wagered on the game.

14. A method of claim 1, further comprising the step of determining a value of the award, comprising the steps of:

1) displaying a matrix of awards of X-columns by Y-rows in accordance with first predetermined criteria;
2) assigning at least one of three values to each of the awards in the matrix in accordance with second predetermined criteria and the value of the awards from the player, and comprising at least one of;
   2*a*) a number of credits;
   2*b*) an "extra life" indicator; and
   2*c*) an end-of-game indicator;
3) randomly arranging a plurality of awards;
4) selecting by the player at least one object from the matrix;
5) revealing the value of the award selected by the player;
6) replacing the selected award with another award;
7) accumulating the value of all awards awarded to the player; and
8) issuing the accumulated value of the awards to the player at the end of the game.

15. A method of claim 14, wherein a number of credits awarded falls within a range of positive integer values determined by an amount of credits wagered on at least one of a pay line and a total amount of credits wagered on the game.

16. A method of claim 14, wherein a number of "extra lives" awarded falls within a range of positive integer values determined by an amount of credits wagered on at least one of a pay line and a total amount of credits wagered on the game.

17. A method of claim 14, further comprising the step of selecting by the player additional objects representing additional awards and accumulating credits and "extra lives" until the player selects an end of game indicator.

18. A method of claim 14, wherein the player collects the accumulated value of the awards upon selection of an end of game indicator, if the player has selected no "extra lives" with which to continue the game.

19. A method of claim 18, wherein each of the "extra lives" indicator negates the end of game indicator.

20. A method of claim 14, wherein each of the "extra lives" indicator used to negate the end of game indicator is removed from the player's accumulated awards.

21. A method of playing a game using a symbol matrix formed by a plurality of rows intersecting with a plurality of columns, with the plurality of rows and columns optionally defining a plurality of pay lines and including a plurality of symbols, comprising:

a) submitting by a player a wager to play the game;
b) selecting by the player at least one of three symbols by touching one of three areas of the display screen associated with each of the three symbols, respectively, the at least one of three symbols selected capable of representing and replacing at least another of the plurality of symbols that appear partially contiguously on an at least one of the pay lines to issue an award;
c) rearranging the plurality of symbols;
d) displaying the rearranged symbols; and
e) awarding the player based on at least one of the following winning arrangements of the rearranged symbols wherein:
   1) when a first at least two predetermined symbols appear contiguously or partially contiguously on at least one of the plurality of pay lines;
   2) when a second at least two predetermined symbols appear anywhere in the symbol matrix;
   3) when a third at least one of: at least two predetermined symbols and at least one selected symbol appear contiguously or partially contiguously on at least one of the plurality of pay lines;
   4) when a fourth at least one of: at least two predetermined symbols and the at least one selected symbol appear anywhere in the symbol matrix; and
   5) when a fifth at least three selected symbols appear anywhere on at least one pay line; and
f) not enhancing the award for winning combinations formed with the at least one selected by the player.

22. A computer implemented system implementing the method of claim 1.

23. A method of playing a game using a symbol matrix formed by a plurality of rows intersecting with a plurality of columns, with the plurality of rows and columns optionally defining a plurality of pay lines and including a plurality of symbols, comprising:

a) a player making a wager to participate in the game;

b) a player selecting one or more symbols from the plurality of symbols that may appear in the symbol matrix;

c) allowing the selected symbol(s) to replace some or all of the plurality of symbols that may appear in the symbol matrix;

d) randomly rearranging the plurality of symbols;

e) displaying the rearranged symbols; and f) awarding the player based on at least one of the following winning combinations of symbols:

1) when two or more predetermined symbols appear contiguously or partially contiguously on at least one of the plurality of pay lines;

2) when two or more predetermined symbols appear anywhere in the symbol matrix;

3) when two or more predetermined symbols and/or selected symbol(s) appear contiguously or partially contiguously on at least one of the plurality of pay lines; and 4) when two or more predetermined symbols and/or selected symbol(s) appear anywhere in the symbol matrix.

24. A method of playing a game using a symbol matrix formed by a plurality of rows intersecting with a plurality of columns, with the plurality of rows and columns optionally defining a plurality of pay lines and including a plurality of symbols, comprising:

a) a player making a wager to participate in the,game;

b) a player selecting one of three symbols that may appear in the symbol matrix by touching one of three areas of the display screen associated with each of the symbols;

c) allowing the selected symbol(s) to only replace symbols that must appear partially contiguously on a pay line to issue an award;

d) randomly rearranging the plurality of symbols;

e) displaying the rearranged symbols; and f) awarding the player based on at least one of the following winning combinations of symbols:

1) when two or more predetermined symbols appear contiguously or partially contiguously on at least one of the plurality of pay lines;

2) when two or more predetermined symbols appear anywhere in the symbol matrix;

3) when two or more predetermined symbols and/or selected symbol(s) appear contiguously or partially contiguously on at least one of the plurality of pay lines;

4) when two or more predetermined symbols and/or selected symbol(s) appear anywhere in the symbol matrix; and 5) the appearance of the three or more selected symbols anywhere on a pay line issues an award.

g) not enhancing the award for winning combinations formed with selected symbol(s).

25. A method of awarding a player, comprising the steps of:

1) displaying a matrix of awards of X-columns by Y-rows in accordance with first predetermined criteria;

2) assigning at least one of three values to each of the awards in the matrix, in accordance with second predetermined criteria, and the value of the awards hidden from the player, comprising at least one of:

2*a*) a number of credits;

2*b*) a multiplier of credits; and

2*c*) an end-of-game indicator;

3) randomly arranging the awards;

4) selecting by the player at least one award from the matrix;

5) revealing the value of the award selected by the player;

6) removing the selected award from the matrix;

7) accumulating the value of all awards awarded to the player; issuing the accumulated value of the awards to the player at the end of the game.

26. A method of awarding player, comprising the steps of:

1) displaying a matrix of awards of X-columns by Y-rows in accordance with first predetermined criteria;

2) assigning at least one of three values to each of the awards in the matrix in accordance with second predetermined criteria and the value of the awards from the player, and comprising at least one of;

2*a*) a number of credits;

2*b*) an "extra life" indicator; and

2*c*) an end-of-game indicator;

3) randomly arranging a plurality of awards;

4) selecting by the player at least one object from the matrix;

5) revealing the value of the award selected by the player;

6) replacing the selected award with another award;

7) accumulating the value of all awards awarded to the player; and 8) issuing the accumulated value of the awards to the player at the end of the game.

* * * * *